US011080999B2

(12) United States Patent
Lin et al.

(10) Patent No.: US 11,080,999 B2
(45) Date of Patent: Aug. 3, 2021

(54) TRAFFIC APPLICATION INSTANCE PROCESSING METHOD AND TRAFFIC CONTROL UNIT

(71) Applicant: HUAWEI TECHNOLOGIES CO., LTD., Guangdong (CN)

(72) Inventors: Yangbo Lin, Shenzhen (CN); Hui Li, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/817,769

(22) Filed: Mar. 13, 2020

(65) Prior Publication Data

US 2020/0211384 A1 Jul. 2, 2020

Related U.S. Application Data

(63) Continuation of application No. PCT/CN2018/102073, filed on Aug. 24, 2018.

(30) Foreign Application Priority Data

Sep. 14, 2017 (CN) ..... 201710827504.4

(51) Int. Cl.
*G08G 1/09* (2006.01)
*G08G 1/01* (2006.01)

(52) U.S. Cl.
CPC ..... *G08G 1/093* (2013.01); *G08G 1/0141* (2013.01)

(58) Field of Classification Search
CPC .... G08G 1/0112; G08G 1/0116; G08G 1/012; G08G 1/0133; G08G 1/0141;
(Continued)

(56) References Cited

U.S. PATENT DOCUMENTS 9,685,077 B2 6/2017 Schlienz et al.
2004/0260460 A1 12/2004 Nishi
(Continued)

FOREIGN PATENT DOCUMENTS

CN 1570992 A 1/2005
CN 101155002 A 4/2008
(Continued)

OTHER PUBLICATIONS

Office Action issued in Chinese Application No. 201710827504.4 dated Mar. 22, 2019, 10 pages (With English Translation).
(Continued)

*Primary Examiner* — Orlando Bousono
(74) *Attorney, Agent, or Firm* — Fish & Richardson P.C.

(57) ABSTRACT

An example method includes obtaining, by a first local traffic control unit (TCU), a traffic application type and first traffic information. The first local TCU can then determine an interaction coverage area based on the traffic application type and the first traffic information. The first local TCU can then determine a first area and send the traffic application type and the first traffic information to a global TCU, where a second local TCU is a local TCU adjacent to the first local TCU, where the first area is at least one overlapping area between a management area of a third local TCU and the interaction coverage area, and where the third local TCU is a local TCU not adjacent to the first local TCU.

19 Claims, 10 Drawing Sheets

(58) Field of Classification Search
CPC ..... G08G 1/0145; G08G 1/091; G08G 1/093; G08G 1/096725; G08G 1/096741; G08G 1/09675; G08G 1/096775; G08G 1/096783; G08G 1/164; G08G 1/166; H04W 4/02; H04W 4/021; H04W 4/027; H04W 4/40; H04W 4/44; H04W 4/90; H04L 67/12
See application file for complete search history.

(56) References Cited

U.S. PATENT DOCUMENTS

| | | | | |
|---|---|---|---|---|
| 2005/0221759 | A1 | 10/2005 | Spadafora et al. | |
| 2008/0074290 | A1 | 3/2008 | Woo et al. | |
| 2016/0155327 | A1 | 6/2016 | Schlienz et al. | |
| 2016/0313730 | A1* | 10/2016 | Ricci | B60C 1/00 |
| 2017/0131712 | A1* | 5/2017 | Ricci | B60W 50/14 |
| 2018/0336780 | A1* | 11/2018 | Ran | G08G 1/0129 |
| 2019/0082377 | A1* | 3/2019 | Silver | G08G 1/096741 |

FOREIGN PATENT DOCUMENTS

| | | | |
|---|---|---|---|
| CN | 104637328 | A | 5/2015 |
| CN | 105679061 | A | 6/2016 |
| CN | 107516416 | A | 12/2017 |
| CN | 107730884 | A | 2/2018 |
| EP | 0982698 | A2 | 3/2000 |
| FR | 2879000 | A1 | 6/2006 |

OTHER PUBLICATIONS

Office Action issued in Chinese Application No. 201710827504.4 dated Aug. 27, 2019, 10 pages (With English Translation).
PCT International Search Report and Written Opinion in International Application No. PCT/CN2018/102,073, dated Nov. 22, 2018, 18 pages (With English Translation).
Extended European Search Report issued in European Application No. 18856619.4 dated Aug. 11, 2020, 13 pages.

* cited by examiner

TRAFFIC APPLICATION INSTANCE PROCESSING METHOD AND TRAFFIC CONTROL UNIT

CROSS-REFERENCE TO RELATED APPLICATIONS

This application is a continuation of International Application No. PCT/CN2018/102073, filed on Aug. 24, 2018, which claims priority to Chinese Patent Application No. 201710827504.4, filed on Sep. 14, 2017, The disclosures of the aforementioned applications are hereby incorporated by reference in their entireties.

TECHNICAL FIELD

The present invention relates to the information processing field, and in particular, to a traffic information processing method and a traffic control unit.

BACKGROUND

An intelligent transportation system (ITS) is a real-time, accurate, efficient, and comprehensive transportation management system that functions in a large range and in full aspects and is established for effectively integrating and applying advanced technologies such as an information technology, a data communications transmission technology, an electronic sensing technology, a control technology, and a computer technology in an entire ground transportation management system, so as to transmit traffic information to traffic participant objects, for example, notify pedestrians and vehicles of traffic signal light switching information at an intersection.

However, in an existing technical solution, the intelligent transportation system mainly broadcasts traffic information. For example, to notify information such as a current location, direction, and speed of a vehicle to another related vehicle, if a dedicated short range communications (DSRC) technology is based on, the vehicle directly broadcasts the information to another surrounding vehicle through a wireless local network; and if a long term evolution for vehicle (LTE-V) technology is based on, the vehicle submits the information to a base station through a wireless cellular network, and then the base station broadcasts the information to another surrounding vehicle through the wireless cellular network.

In this case, how to purposefully determine an area for transferring traffic information and how to reduce waste of communication and processing resources are worth considering.

SUMMARY

A technical problem to be resolved in embodiments of the present invention is providing a traffic information processing method and a traffic control unit, so that an interaction coverage area may be purposefully determined based on a traffic scenario, and through division of processing of traffic information by a local TCU and a global TCU, waste of communication and processing resources is reduced.

According to a first aspect, an embodiment of the present invention provides a traffic information processing method, including:

obtaining, by a first local TCU, a traffic application type and first traffic information, where the traffic application type is used to indicate a to-be-processed traffic scenario, and the first traffic information is information about a traffic target object in a management area of the first local TCU; determining, by the first local TCU, an interaction coverage area based on the traffic application type and the first traffic information, where the interaction coverage area is used to indicate a geographical area related in the to-be-processed traffic scenario; and determining, by the first local TCU, a first area based on the interaction coverage area, the management area of the first local TCU, and a management area of a second local TCU, and sending the traffic application type and the first traffic information to a global TCU, where the second local TCU is a local TCU adjacent to the first local TCU, the first area is at least one overlapping area between a management area of a third local TCU and the interaction coverage area and the interaction coverage area, the third local TCU is a local TCU not adjacent to the first local TCU, a management area of the global TCU is divided into a management area of at least one local TCU, and the management area of the at least one local TCU includes the management area of the first local TCU.

In the first aspect, when the first local TCU initially determines the traffic application type and the first traffic information of the traffic target object, the first local TCU may purposefully determine the interaction coverage area based on the traffic scenario, or may accurately determine a traffic participant object related in the interaction coverage area and provide interactive support for the traffic participant object, to purposefully transfer traffic information. Through division of processing of traffic information by a local TCU and a global TCU, waste of communication and processing resources caused by broadcasting traffic information in a large range is reduced.

In an optional embodiment, after the determining, by the first local TCU, an interaction coverage area based on the traffic application type and the first traffic information, the method further includes:

determining, by the first local TCU, a second area based on the interaction coverage area and the management area of the first local TCU, where the second area is an overlapping area between the management area of the first local TCU and the interaction coverage area;

determining, by the first local TCU, a traffic participant object in the second area; and sending, by the first local TCU, the first traffic information to the traffic participant object, or receiving, by the first local TCU, second traffic information sent by the traffic participant object and sending the second traffic information to the traffic target object.

In an optional embodiment, the determining, by the first local TCU, a traffic participant object in the second area includes:

determining, as the traffic participant object by the first local TCU, a communicable object that appears in the second area within a preset time.

In an optional embodiment, the second traffic information includes location information of the traffic participant object; or the second traffic information includes location information and status information of the traffic participant object.

In an optional embodiment, after the sending, by the first local TCU, the first traffic information to the traffic participant object, the method further includes:

receiving, by the first local TCU, a first message sent by the traffic participant object, where the first message is used to indicate that the traffic participant object has acknowledged receiving of the first traffic information.

In an optional embodiment, after the receiving, by the first local TCU, second traffic information of the traffic participant object, the method further includes:

sending, by the first local TCU, a second message to the traffic participant object, where the second message is used to indicate that the traffic participant object has acknowledged receiving of the second traffic information.

In an optional embodiment, before the receiving, by the first local TCU, second traffic information sent by the traffic participant object and sending the second traffic information to the traffic target object, the method further includes:

sending, by the first local TCU, indication information to the traffic participant object, where the indication information is used to instruct the traffic participant object to send the second traffic information to the first local TCU.

In an optional embodiment, after the determining, by the first local TCU, an interaction coverage area based on the traffic application type and the first traffic information, the method further includes:

determining, by the first local TCU, a third area based on the interaction coverage area and the management area of the second local TCU, where the third area is an overlapping area between the management area of the second local TCU and the interaction coverage area; and sending, by the first local TCU, the traffic application type and the first traffic information to the second local TCU.

In an optional embodiment, after the sending, by the first local TCU, the traffic application type and the first traffic information to the second local TCU, the method further includes:

receiving, by the first local TCU, a third message sent by the second local TCU, where the third message is used to indicate that the second local TCU has acknowledged receiving of the traffic application type and the first traffic information.

In an optional embodiment, if the first area exists, after the sending, by the first local TCU, the traffic application type and the first traffic information to a global TCU, the method further includes:

receiving, by the first local TCU, a fourth message sent by the global TCU, where the fourth message is used to indicate that the global TCU has acknowledged receiving of the traffic application type and the first traffic information.

In an optional embodiment, the obtaining, by a first local traffic control unit TCU, a traffic application type and first traffic information includes:

obtaining, by the first local TCU, the traffic application type and the first traffic information of the traffic target object according to a preset condition; or receiving, by the first local TCU, the first traffic information, and determining the traffic application type based on the first traffic information; or determining, by the first local TCU, the first traffic information and the traffic application type based on a received traffic application request of the traffic target object, where the traffic application request includes the first traffic information and a request type, and the request type is used to determine the traffic application type.

In an optional embodiment, the first traffic information includes location information of the traffic target object; or the first traffic information includes location information and status information of the traffic target object.

In an optional embodiment, the location information of the traffic target object is a current location of the traffic target object; and the determining, by the first local TCU, an interaction coverage area based on the traffic application type and the first traffic information includes:

determining, as the interaction coverage area by the first local TCU based on the traffic application type and map information, a geographical area with a distance from the current location falling within a first distance threshold by using the current location of the traffic target object as a start point, where the first distance threshold is determined based on the traffic application type.

In an optional embodiment, before the obtaining, by a first local traffic control unit TCU, a traffic application type and first traffic information, the method further includes:

obtaining, by the first local TCU, an identifier and the management area of the second local TCU.

In an optional embodiment, before the obtaining, by a first local traffic control unit TCU, a traffic application type and first traffic information, the method further includes:

sending, by the first local TCU, an identifier and the management area of the first local TCU to the global TCU.

According to a second aspect, an embodiment of the present invention provides a traffic information processing method, including:

obtaining, by a global traffic control unit TCU, a traffic application type and first traffic information, where the traffic application type is used to indicate a to-be-processed traffic scenario, the first traffic information is information about a traffic target object in a management area of the global TCU, and the management area of the global TCU is divided into a management area of at least one local TCU;

determining, by the global TCU, an interaction coverage area based on the traffic application type and the first traffic information, where the interaction coverage area is used to indicate a geographical area related in the to-be-processed traffic scenario;

determining, by the global TCU, a target local TCU based on the interaction coverage area and the management area of the at least one local TCU, where there is an overlapping area between a management area of the target local TCU and the interaction coverage area; and sending, by the global TCU, the traffic application type and the first traffic information to the target local TCU.

In the second aspect, when the global TCU initially determines the traffic application type and the first traffic information of the traffic target object, the interaction coverage area may be purposefully determined based on the traffic scenario. In addition, a local TCU whose management area has an overlapping area with the interaction coverage area may determine a related traffic participant object, so as to technically support the traffic participant object, and to purposefully transfer traffic information, thereby reducing waste of communication and processing resources caused by broadcasting traffic information in a large range.

In an optional embodiment, the obtaining, by a global traffic control unit TCU, a traffic application type and first traffic information includes:

obtaining, by the global TCU, the traffic application type and the first traffic information of the traffic target object according to a preset condition; or receiving, by the global TCU, the first traffic information, and determining the traffic application type based on the first traffic information; or determining, by the global TCU, the first traffic information and the traffic application type based on a received traffic application request of the traffic target object, where the traffic application request includes the first traffic information and a request type, and the request type is used to determine the traffic application type.

In an optional embodiment, after the sending, by the global TCU, the traffic application type and the first traffic information to the target local TCU, the method further includes:

receiving, by the global TCU, a first message sent by the target local TCU, where the first message is used to indicate that the target local TCU has acknowledged receiving of the traffic application type and the first traffic information.

In an optional embodiment, the first traffic information includes location information of the traffic target object; or the first traffic information includes location information and status information of the traffic target object.

In an optional embodiment, the location information of the traffic target object is a current location of the traffic target object; and the determining, by the global TCU, an interaction coverage area based on the traffic application type and the first traffic information includes:

determining, as the interaction coverage area by the global TCU based on the traffic application type and map information, a geographical area with a distance from the current location falling within a first distance threshold by using the current location of the traffic target object as a start point, where the first distance threshold is determined based on the traffic application type.

In an optional embodiment, the method further includes:

obtaining, by the global TCU, an identifier and a management area of a first local TCU, where the first local TCU is any one of the at least one local TCU.

In an optional embodiment, the method further includes:

receiving, by the global TCU, second traffic information sent by the target local TCU, and sending the second traffic information to the traffic target object, where the second traffic information is information about a traffic participant object in the management area of the target local TCU.

In an optional embodiment, the second traffic information includes location information of the traffic participant object; or the second traffic information includes location information and status information of the traffic participant object.

According to a third aspect, an embodiment of the present invention provides a traffic information processing method, including:

receiving, by a global traffic control unit TCU, a traffic application type and first traffic information that are sent by a first local TCU, where the traffic application type is used to indicate a to-be-processed traffic scenario, the first traffic information is information about a traffic target object in a management area of the global TCU, the management area of the global TCU is divided into a management area of at least one local TCU, the management area of the at least one local TCU includes a management area of the first local TCU, and the management area of the global TCU is divided into a management area of at least one local TCU;

determining, by the global TCU, an interaction coverage area based on the traffic application type and the first traffic information, where the interaction coverage area is used to indicate a geographical area related in the to-be-processed traffic scenario;

determining, by the global TCU, a target local TCU based on the interaction coverage area and the management area of the at least one local TCU, where the target local TCU does not include the first local TCU and a second local TCU, the second local TCU is a local TCU adjacent to the first local TCU, and there is an overlapping area between a management area of the target local TCU and the interaction coverage area; and sending, by the global TCU, the traffic application type and the first traffic information to the target local TCU.

In the third aspect, when the traffic application type and the first traffic information of the traffic target object are not initially determined by the global TCU, the interaction coverage area may be purposefully determined based on the traffic scenario, local TCUs, except an initial TCU and a TCU adjacent to the initial TCU, whose management areas having overlapping areas with the interaction coverage area, and a related traffic participant object is further determined, so as to technically support the traffic participant object, and to purposefully transfer traffic information, thereby reducing waste of communication and processing resources caused by broadcasting traffic information in a large range.

In an optional embodiment, after the sending, by the global TCU, the traffic application type and the first traffic information to the target local TCU, the method further includes:

receiving, by the global TCU, a first message sent by the target local TCU, where the first message is used to indicate that the target local TCU has acknowledged receiving of the traffic application type and the first traffic information.

In an optional embodiment, the first traffic information includes location information of the traffic target object; or the first traffic information includes location information and status information of the traffic target object.

In an optional embodiment, the location information of the traffic target object is a current location of the traffic target object; and the determining, by the global TCU, an interaction coverage area based on the traffic application type and the first traffic information includes:

determining, as the interaction coverage area by the global TCU based on the traffic application type and map information, a geographical area with a distance from the current location falling within a first distance threshold by using the current location of the traffic target object as a start point, where the first distance threshold is determined based on the traffic application type.

In an optional embodiment, the method further includes:

obtaining, by the global TCU, an identifier and the management area of a first local TCU, where the first local TCU is any one of the at least one local TCU.

In an optional embodiment, the method further includes:

receiving, by the global TCU, second traffic information sent by the target local TCU, and sending the second traffic information to the traffic target object by using the first local TCU, where the second traffic information is information about a traffic participant object in the management area of the target local TCU.

In an optional embodiment, the second traffic information includes location information of the traffic participant object; or the second traffic information includes location information and status information of the traffic participant object.

According to a fourth aspect, an embodiment of the present invention provides a traffic information processing method, including:

receiving, by a first local traffic control unit TCU, a traffic application type and first traffic information of a traffic target object that are sent by a second local TCU or a global TCU, where the traffic application type is used to indicate a to-be-processed traffic scenario, the second local TCU is a local TCU adjacent to the first local TCU, a management area of the global TCU is divided into a management area of at least one local TCU, and the management area of the at least one local TCU includes a management area of the first local TCU and a management area of the second local TCU;

determining, by the first local TCU, an interaction coverage area based on the traffic application type and the first traffic information, where the interaction coverage area is used to indicate a geographical area related in the to-be-processed traffic scenario;

determining, by the first local TCU, a first area based on the interaction coverage area and the management area of the first local TCU, where the first area is an overlapping area between the management area of the first local TCU and the interaction coverage area;

determining, by the first local TCU, a traffic participant object in the first area; and sending, by the first local TCU, the first traffic information to the traffic participant object, or receiving, by the first local TCU, second traffic information sent by the traffic participant object and sending the second traffic information to the traffic target object.

In the fourth aspect, when the traffic application type and the first traffic information of the traffic target object are not initially determined by the first local TCU, the interaction coverage area may be purposefully determined based on the traffic scenario, an overlapping area may be determined based on the management area of the first local TCU and the interaction coverage area, and a related traffic participant object is further determined, so as to technically support the traffic participant object, and to purposefully transfer traffic information, thereby reducing waste of communication and processing resources caused by broadcasting traffic information in a large range.

In an optional embodiment, the determining, by the first local TCU, a second traffic participant object in the overlapping area includes:

determining, as the traffic participant object by the first local TCU, a communicable object that appears in the second area within a preset time.

In an optional embodiment, the second traffic information includes location information of the traffic participant object; or the second traffic information includes location information and status information of the traffic participant object.

In an optional embodiment, after the sending, by the first local TCU, the first traffic information to the traffic participant object, the method further includes:

receiving, by the first local TCU, a first message sent by the traffic participant object, where the first message is used to indicate that the traffic participant object has acknowledged receiving of the first traffic information.

In an optional embodiment, after the receiving, by the first local TCU, second traffic information sent by the traffic participant object, the method further includes:

sending, by the first local TCU, a second message to the traffic participant object, where the second message is used to indicate that the traffic participant object has acknowledged receiving of the second traffic information.

In an optional embodiment, before the receiving, by the first local TCU, second traffic information sent by the traffic participant object and sending the second traffic information to the traffic target object, the method further includes:

sending, by the first local TCU, indication information to the traffic participant object, where the indication information is used to instruct the traffic participant object to feed back the second traffic information.

In an optional embodiment, the first traffic information includes location information of the traffic target object; or the first traffic information includes location information and status information of the traffic target object.

In an optional embodiment, the location information of the traffic target object is a current location of the traffic target object; and the determining, by the first local TCU, an interaction coverage area based on the traffic application type and the first traffic information includes:

determining, as the interaction coverage area by the first local TCU based on the traffic application type and map information, a geographical area with a distance from the current location falling within a first distance threshold by using the current location of the traffic target object as a start point, where the first distance threshold is determined based on the traffic application type.

In an optional embodiment, the method further includes:

obtaining, by the first local TCU, an identifier and the management area of the second local TCU.

In an optional embodiment, before the receiving, by a first local traffic control unit TCU, a traffic application type and first traffic information of a traffic target object that are sent by a second local TCU or a global TCU, the method further includes:

sending, by the first local TCU, an identifier and the management area of the first local TCU to the global TCU.

In an optional embodiment, the sending, by the first local TCU, the second traffic information to the traffic target object includes:

when the traffic application type and the first traffic information are sent by the second local TCU, sending, by the first local TCU, the second traffic information to the traffic target object by using the second local TCU; or when the traffic application type and the first traffic information are sent by the global TCU, sending, by the first local TCU, the second traffic information to the traffic target object by using the global TCU.

According to a fifth aspect, an embodiment of the present invention provides a traffic control apparatus, where the traffic control apparatus is a first local TCU, and the first local TCU includes:

a processing module, configured to obtain a traffic application type and first traffic information, where the traffic application type is used to indicate a to-be-processed traffic scenario, and the first traffic information is information about a traffic target object in a management area of the first local TCU, where the processing module is further configured to determine an interaction coverage area based on the traffic application type and the first traffic information, where the interaction coverage area is used to indicate a geographical area related in the to-be-processed traffic scenario; and the processing module is further configured to determine a first area based on the interaction coverage area, the management area of the first local TCU, and a management area of a second local TCU, where the second local TCU is a local TCU adjacent to the first local TCU, the first area is at least one overlapping area between a management area of a third local TCU and the interaction coverage area and the interaction coverage area, and the third local TCU is a local TCU not adjacent to the first local TCU; and a transceiver module, configured to: if the first area exists, send the traffic application type and the first traffic information to a global TCU, where a management area of the global TCU is divided into a management area of at least one local TCU, and the management area of the at least one local TCU includes the management area of the first local TCU.

Optionally, the traffic control apparatus may further implement some or all optional implementations of the first aspect.

According to a sixth aspect, an embodiment of the present invention provides a traffic control apparatus, where the traffic control apparatus is a global TCU, and the global TCU includes:

a processing module, configured to obtain a traffic application type and first traffic information, where the traffic application type is used to indicate a to-be-processed traffic scenario, the first traffic information is information about a traffic target object in a management area of the global TCU, and the management area of the global TCU is divided into a management area of at least one local TCU, where the processing module is further configured to determine an interaction coverage area based on the traffic application type and the first traffic information, where the interaction coverage area is used to indicate a geographical area related in the to-be-processed traffic scenario; and the processing module is further configured to determine a target local TCU based on the interaction coverage area and the management area of the at least one local TCU, where there is an overlapping area between a management area of the target local TCU and the interaction coverage area; and a transceiver module, configured to send the traffic application type and the first traffic information to the target local TCU.

Optionally, the traffic control apparatus may further implement some or all optional implementations of the second aspect.

According to a seventh aspect, an embodiment of the present invention provides a traffic control apparatus, where the traffic control apparatus is a global TCU, and the global TCU includes:

a transceiver module, configured to receive a traffic application type and first traffic information that are sent by a first local TCU, where the traffic application type is used to indicate a to-be-processed traffic scenario, the first traffic information is information about a traffic target object in a management area of the global TCU, the management area of the global TCU is divided into a management area of at least one local TCU, the management area of the at least one local TCU includes a management area of the first local TCU, and the management area of the global TCU is divided into a management area of at least one local TCU; and a processing module, configured to determine an interaction coverage area based on the traffic application type and the first traffic information, where the interaction coverage area is used to indicate a geographical area related in the to-be-processed traffic scenario, where the processing module is further configured to determine a target local TCU based on the interaction coverage area and the management area of the at least one local TCU, where the target local TCU does not include the first local TCU and a second local TCU, the second local TCU is a local TCU adjacent to the first local TCU, and there is an overlapping area between a management area of the target local TCU and the interaction coverage area; and the transceiver module is further configured to send the traffic application type and the first traffic information to the target local TCU.

Optionally, the traffic control apparatus may further implement some or all optional implementations of the third aspect.

According to an eighth aspect, an embodiment of the present invention provides a traffic control apparatus, where the traffic control apparatus is a first local TCU, and the first local TCU includes:

a transceiver module, configured to receive a traffic application type and first traffic information of a traffic target object that are sent by a second local TCU or a global TCU, where the traffic application type is used to indicate a to-be-processed traffic scenario, the second local TCU is a local TCU adjacent to the first local TCU, a management area of the global TCU is divided into a management area of at least one local TCU, and the management area of the at least one local TCU includes a management area of the first local TCU and a management area of the second local TCU; and a processing module, configured to determine an interaction coverage area based on the traffic application type and the first traffic information, where the interaction coverage area is used to indicate a geographical area related in the to-be-processed traffic scenario, where the processing module is further configured to determine a first area based on the interaction coverage area and the management area of the first local TCU, where the first area is an overlapping area between the management area of the first local TCU and the interaction coverage area;

the processing module is further configured to determine a traffic participant object in the first area; and the transceiver module is further configured to send the first traffic information to the traffic participant object, or the transceiver module is further configured to: receive second traffic information sent by the traffic participant object and send the second traffic information to the traffic target object.

Optionally, the traffic control apparatus may further implement some or all optional implementations of the fourth aspect.

According to a ninth aspect, a traffic control apparatus is provided. The traffic control apparatus includes a memory, configured to store computer executable program code; a transceiver; and a processor, where the processor is coupled to the memory and the transceiver. The program code stored in the memory includes an instruction, and when the processor executes the instruction, the traffic control apparatus is enabled to perform the method performed by the traffic control apparatus in any possible design of the first aspect, the second aspect, the third aspect, or the fourth aspect.

According to a tenth aspect, a computer program product is provided, and the computer program product includes computer program code. When the computer program code runs on a computer, the computer is enabled to perform the method in any one of the first aspect to the fourth aspect and the possible implementations of the first aspect to the fourth aspect.

According to an eleventh aspect, a computer-readable medium is provided, and the computer-readable medium stores computer program code. When the computer program code runs on a computer, the computer is enabled to perform the method in any one of the first aspect to the fourth aspect and the possible implementations of the first aspect to the fourth aspect.

BRIEF DESCRIPTION OF DRAWINGS

To describe the technical solutions in the embodiments of the present invention or in the background more clearly, the following briefly describes the accompanying drawings required for describing the embodiments of the present invention or the background.

DESCRIPTION OF EMBODIMENTS

The following describes the embodiments of the present invention with reference to the accompanying drawings in the embodiments of the present invention.

Figure 1:
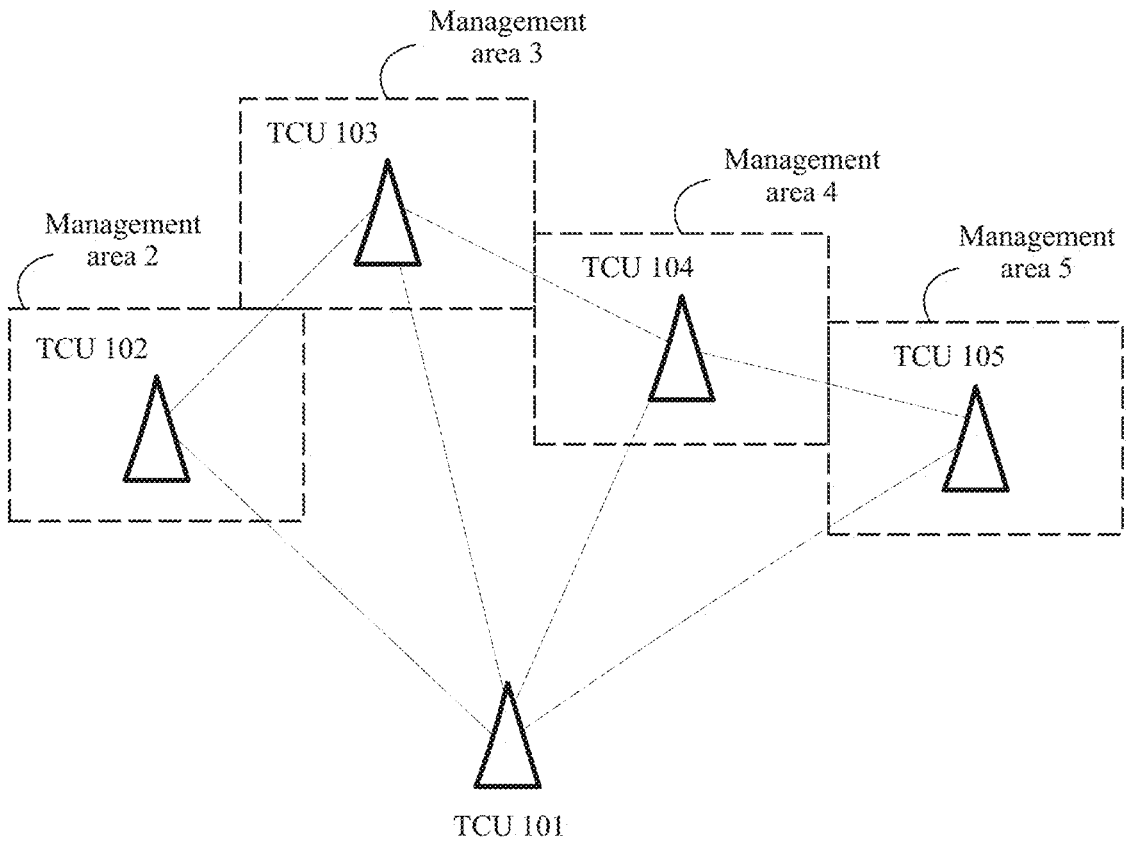
FIG. 1 is a schematic diagram of a possible system architecture of an intelligent transportation system according to an embodiment of the present invention.

FIG. 1 is a schematic diagram of a possible system architecture of an intelligent transportation system according to an embodiment of this application. In the architectural diagram of the intelligent transportation system, a plurality of traffic control units (TCU) are included, and the plurality of TCUs may be divided into a global TCU and a plurality of local TCUs. A management area of the global TCU is divided into a management area of at least one local TCU. The global TCU may communicate with each local TCU, and may further communicate with a traffic participant object in a management area of each local TCU. A local TCU is mainly responsible for coordinating activities of a traffic participant object in a management area of the local TCU, and communicating with a local TCU adjacent to the local TCU. The traffic participant object may include a vehicle, a roadside infrastructure, a pedestrian, and the like. The local TCU adjacent to the local TCU means a local TCU corresponding to a management area adjacent to the management area of the local TCU.

In the intelligent transportation system shown in FIG. 1, a TCU 101 is a global TCU, and a TCU 102, a TCU 103, a TCU 104, and a TCU 105 are local TCUs. The TCU 101 may separately communicate with the TCU 102, the TCU 103, the TCU 104, and the TCU 105, and may also determine an identifier and a management area of each local TCU. Management areas of the TCU 102, the TCU 103, the TCU 104, and the TCU 105 are respectively a management area 2, a management area 3, a management area 4, and a management area 5. Management areas corresponding to the TCU 101 include the management area 2, the management area 3, the management area 4, and the management area 5. The TCU 103 is used as an example. The TCU 103 is responsible for coordinating activities of a traffic participant object in the management area 3 and communicating with the TCU 102 and the TCU 104 adjacent to the TCU 103.

Based on the system architecture, in a possible design, when each local TCU is deployed or updated, each local TCU may notify an identifier and a management area of each local TCU to a local TCU adjacent to each local TCU, so that each local TCU can learn of a second local TCU and a management area of each second local TCU; and notify an identifier and a management area of each local TCU to the global TCU, so that the global TCU can learn of a management area of each local TCU, and further, the global TCU may determine, based on the management area of each local TCU, the local TCU adjacent to each local TCU and the management area of each second local TCU.

Traffic scenarios in the embodiments of the present invention may include but are not limited to: a traffic signal notification scenario in which traffic signal light switching information at an intersection needs to be notified to a vehicle and a pedestrian that are to enter the intersection; a forward congestion prompt scenario in which current congestion information needs to be notified to a vehicle and a pedestrian within a specific distance or a specific quantity of intersections; a dangerous obstacle alarm scenario in which current dangerous obstacle information needs to be notified to a vehicle and a pedestrian within a specific distance or a specific quantity of intersections; an emergency vehicle prompt scenario in which an emergency vehicle needs to be notified to a vehicle and a pedestrian that are in a traveling direction of the emergency vehicle and that are within a distance from a current location; a vulnerable traffic participant object warning scenario in which a current location of a vulnerable traffic participant object needs to be notified to a vehicle and a pedestrian that are on a road connected around the vulnerable traffic participant object, that are in a direction to approach the vulnerable traffic participant object, and that are within a specific distance from the vulnerable traffic participant object; and a vehicle collision prevention scenario in which a vehicle needs to be alerted to a surrounding motion status of the vehicle and information about an object that have a risk of colliding with the vehicle.

Figure 2A:
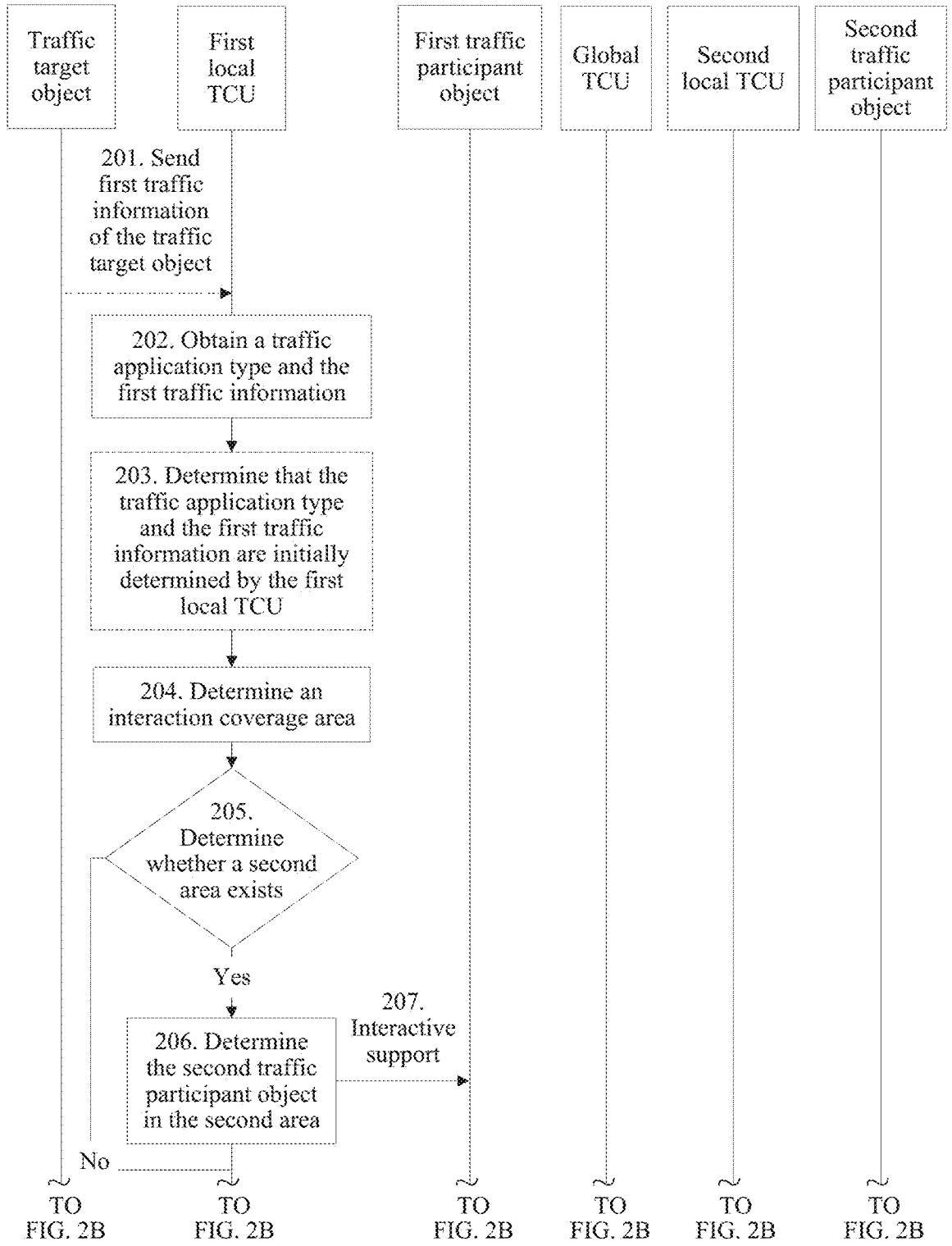
FIG. 2A, FIG. 2B, and FIG. 2C are a schematic flowchart of a traffic information processing method according to an embodiment of the present invention.
Figure 2B:
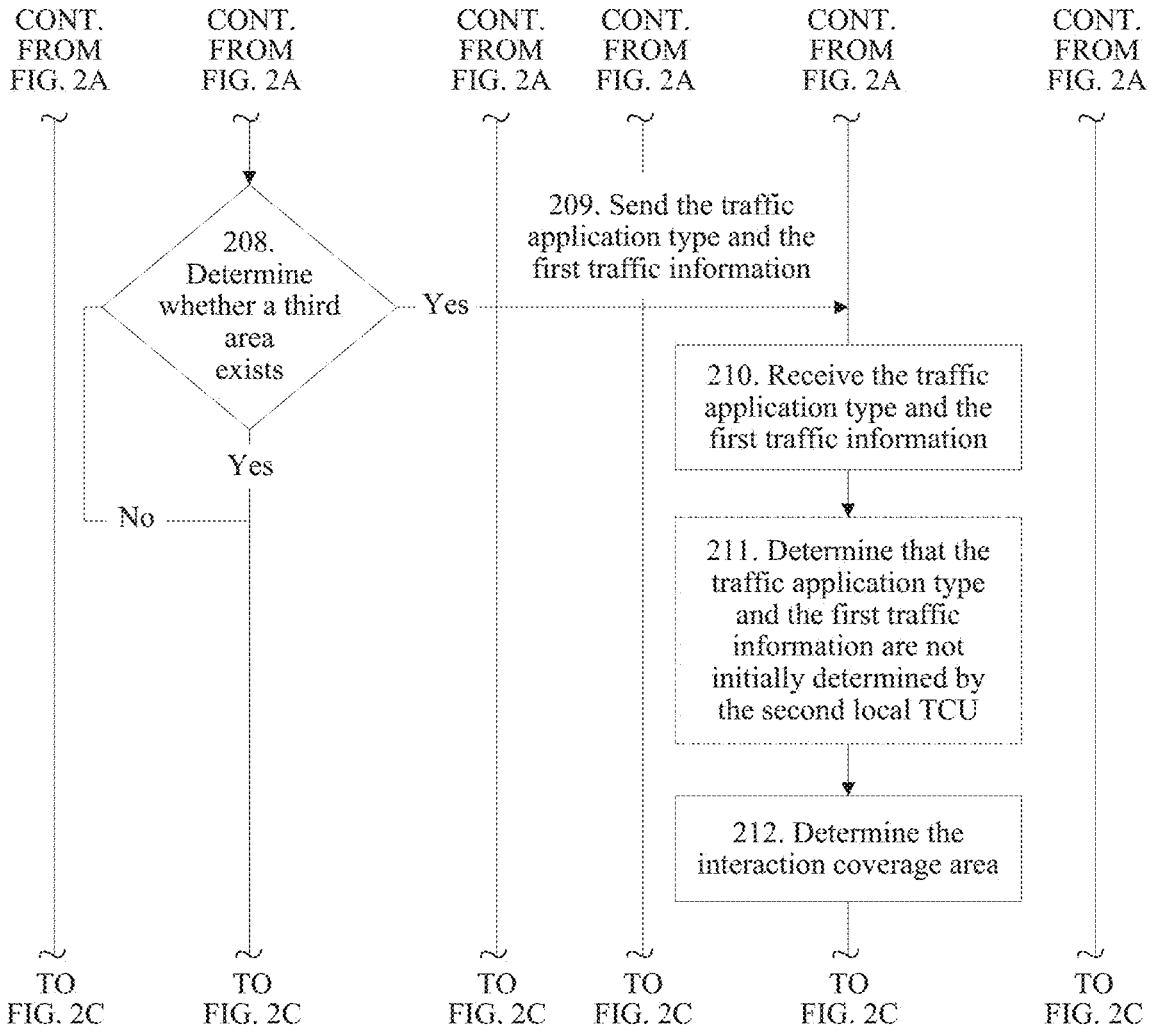
Figure 2C:
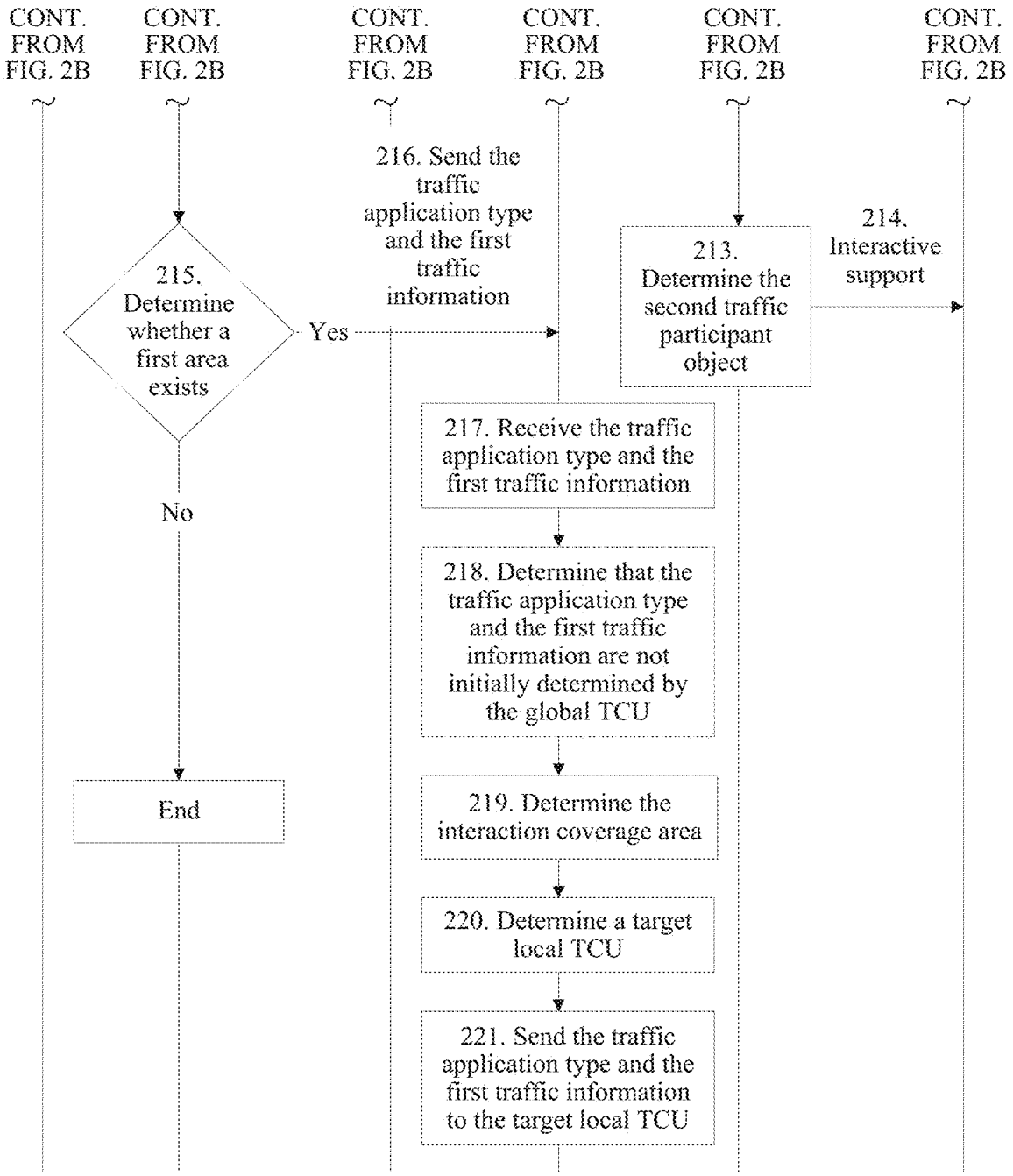

Based on the diagram of the system architecture in FIG. 1, FIG. 2A, FIG. 2B, and FIG. 2C are a schematic flowchart of a traffic information processing method according to an embodiment of the present invention. In this embodiment, a first local TCU, a second local TCU, and a global TCU are included. A management area of the global TCU is divided into a management area of at least one local TCU, the management area of the at least one local TCU includes a management area of the first local TCU and a management area of the second local TCU, and the second local TCU is a local TCU that is determined in TCUs adjacent to the first local TCU and whose management area has an overlapping area with an interaction coverage area. As shown in FIG. 2A, FIG. 2B, and FIG. 2C, the traffic information processing method further relates to a traffic target object, a first traffic participant object, and a second traffic participant object. The embodiment shown in FIG. 2A, FIG. 2B, and FIG. 2C is a specific implementation on the basis that the first local TCU is a TCU that initially obtains a traffic application type and first traffic information.

As shown in FIG. 2A, FIG. 2B, and FIG. 2C, the traffic information processing method includes step 201 to step 221.

201. The traffic target object sends first traffic information of the traffic target object to the first local TCU.

The first traffic information is information about the traffic target object, where the traffic target object may be an object such as a pedestrian, a vehicle, or a traffic infrastructure. The first traffic information of the traffic target object may include various traffic information related to the traffic target object, for example, may include information about an identifier, a location, and a status of the traffic target object, or may include traffic environment information, disaster information, or the like.

Correspondingly, the first local TCU receives the first traffic information sent by the traffic target object.

202. The first local TCU obtains a traffic application type and the first traffic information.

The traffic application type is used to indicate a to-be-processed traffic scenario. For example, a traffic application type prompted by an emergency vehicle indicates that the to-be-processed traffic scenario of the first local TCU is that the first local TCU needs to prompt another vehicle in a direction of the emergency vehicle, so that the another vehicle gives way to the emergency vehicle. There are the following several possible implementation scenarios in which the first local TCU obtains the traffic application type and the first traffic information of the traffic target object:

In a first possible implementation scenario, step 202 may be specifically: The first local TCU obtains the traffic application type and the first traffic information of the traffic target object according to a preset condition.

The preset condition may be a timing time, an information type, an instruction type, or the like that is preset in the first local TCU. When detecting that the preset condition is met, the first local TCU may trigger an action of obtaining the traffic application type and the first traffic information of the traffic target object. For example, if the preset condition is that a preset first time arrives, the first local TCU may obtain the traffic application type and the first traffic information of the traffic target object when the first time arrives.

The first traffic information of the traffic target object may be collected in advance by the first local TCU by using the traffic target object, another TCU, a network unit, or the like, which is not specifically limited herein.

After obtaining the first traffic information, the first local TCU may determine a corresponding traffic application type through analysis, or may determine a traffic application type according to the preset condition. The traffic application type herein may be represented by using an identifier of the traffic application type. In this way, the first local TCU may obtain the traffic application type and the first traffic information of the traffic target object. For example, if the first traffic information is related information such as a location and a status of an emergency vehicle, the first local TCU may determine, based on the first traffic information, that the traffic application type is an emergency vehicle prompt application type. If the preset condition has indicated that the traffic application type is a traffic signal light information notification application type, the first local TCU determines the traffic application type according to the preset condition.

Further, the first local TCU may create, based on the traffic application type and the first traffic information of the traffic target object, a traffic application instance corresponding to the traffic application type. The traffic application instance means an actual running of a traffic application. For example, a running of a traffic signal notification application is an instance of the traffic signal notification application. In a process of creating an instance, the first local TCU may allocate an instance identifier to the traffic application instance, and the instance identifier may uniquely represent the traffic application instance.

For example, if the first traffic information includes information about a traffic signal (an identifier, a location, a phase status, and remaining duration of a current phase status), the first local TCU may determine, through analysis, that a traffic application type corresponding to the first traffic information is a traffic signal notification application type, create a traffic signal notification application instance, and allocate an instance identifier of the traffic signal notification application instance.

In a second possible implementation scenario, step 202 may be specifically: Corresponding to step 201, the first local TCU receives the first traffic information of the traffic target object, and then the first local TCU determines the traffic application type based on the first traffic information of the traffic target object.

The first local TCU may determine, through analysis, the traffic application type corresponding to the first traffic information based on content in the received first traffic information. In this way, the first local TCU may obtain the traffic application type and the first traffic information of the traffic target object. Further, the first local TCU may create, based on the traffic application type and the first traffic information of the traffic target object, a traffic application instance corresponding to the traffic application type.

In a third possible implementation scenario, step 202 may be specifically: The first local TCU determines the traffic application type and the first traffic information of the traffic target object based on a received traffic application request of the traffic target object.

The traffic application request may include the first traffic information of the traffic target object and a request type, and the request type is used to determine the traffic application type.

After receiving the traffic application request of the traffic target object, the first local TCU may determine a corresponding traffic application type based on the request type in the traffic application request. In this way, the first local TCU may obtain the traffic application type and the first traffic information of the traffic target object. For example, the request type in the traffic application request is a path planning service request, and the first local TCU may determine, based on the path planning service request, that a corresponding traffic application type is a road condition query application type. Further, the first local TCU may create, based on the traffic application type and the first traffic information of the traffic target object, a traffic application instance corresponding to the traffic application type.

It should be noted that the traffic application request of the traffic target object may be sent by the traffic target object to the first local TCU, or may be sent by another traffic object to the first local TCU. For example, when the traffic target object is a vehicle and needs to learn of object information in a blind area around the vehicle, the traffic target object may directly send, to the first local TCU, a traffic application request whose request type is a blind area alarm. When the traffic target object is a disabled person, another traffic object is a roadside monitoring device, and the roadside monitoring device detects, through monitoring, that the disabled person appears, the roadside monitoring device may send, to the first local TCU, a traffic application request for the traffic target object (disabled person) whose request type is disabled person prompt.

203. The first local TCU determines that the traffic application type and the first traffic information are initially determined by the first local TCU.

With reference to a plurality of possible cases described in step 202, the first local TCU determines the traffic application type and the first traffic information, and may determine that the traffic application type and the first traffic information are initially determined by the first local TCU. Optionally, with reference to a plurality of possible cases described in step 202, after the first local TCU creates a traffic application instance, step 203 may be further replaced with: the first local TCU determines that the traffic application instance is initially created by the first local TCU.

This step is an optional step. In this embodiment of the present invention, if the first local TCU determines a traffic application type and first traffic information in the plurality of possible cases described in step 202, the step performed by the first local TCU in this embodiment of the present invention can be performed without performing step 203.

204. The first local TCU determines an interaction coverage area based on the traffic application type and the first traffic information.

The interaction coverage area is used to indicate a geographical area related in the to-be-processed traffic scenario. For example, the to-be-processed traffic scenario is a notification scenario of information about a traffic signal light. In this case, the related geographical area may be a part of area on a road controlled by the traffic signal light, and the part of area may be the interaction coverage area.

After determining the traffic application type and the first traffic information of the traffic target object, the first local TCU may determine the interaction coverage area based on the traffic application type and the first traffic information of the traffic target object. In specific implementation, the first local TCU may determine the interaction coverage area based on the traffic application type, the first traffic information of the traffic target object, and map information. The first traffic information may include location information of the traffic target object, or may include location information and status information of the traffic target object.

In a possible implementation scenario, the first traffic information may include location information of the traffic target object, and the location information of the traffic target object may be specifically a current location of the traffic target object. The first local TCU determines, as the interaction coverage area of the traffic scenario based on the traffic application type, the first traffic information of the traffic target object, and map information, a geographical area with a distance from the current location falling within a first distance threshold by using the current location of the traffic target object as a start point. The first distance threshold may be determined based on the traffic application type, in other words, different traffic application types may correspond to different first distance thresholds.

Specifically, a start point of the interaction coverage area is determined by using the current location of the traffic target object, and the first distance threshold may be determined by using the traffic application type. Then, the first local TCU may determine, based on the traffic application type and the map information, an area obtained after the first distance threshold is extended from the start point to a specific direction or a specific road, in other words, determine, as the interaction coverage area, the geographical area with the distance from the current location falling within the first distance threshold by using the current location of the traffic target object as the start point.

For example, it is assumed that the traffic target object is a traffic signal light S, the traffic application type is a traffic signal light information notification application type, and the location information of the traffic target object is a current location A of the traffic signal light S. It is assumed that the traffic signal notification application type indicates that an area that is on a road controlled by a traffic signal light and that is within a distance of 2 km (the first distance threshold) from the traffic signal light S is used as an interaction coverage area, and the first local TCU may use the current location A of the traffic signal light S as a start point and determine, with reference to map information, a geographical area that is on the road controlled by the traffic signal light S and that is within a distance of 2 km from the traffic signal light S, and determine the geographical area as an interaction coverage area corresponding to a traffic scenario indicated by the traffic signal notification application type.

In another possible implementation scenario, the first traffic information may include location information and status information of the traffic target object. The status information may mean a speed, an angular velocity, an acceleration, a motion direction, or the like. In this case, the first local TCU needs to determine, as the interaction coverage area based on the traffic application type, the first traffic information of the traffic target object, and map information, a geographical area with a distance from a current location falling within a first distance threshold in a specific direction by using the current location of the traffic target object as a start point. Different from the foregoing possible implementation scenario, parameters of the interaction coverage area such as the specific direction and the first distance threshold that extends outwards by using the current location of the traffic target object as a start point are determined not only by using the traffic application type and the map information, but also by using the status information of the traffic target object.

For example, it is assumed that the traffic target object is an emergency vehicle E, the traffic application type is an emergency vehicle prompt application type, the location information of the traffic target object is a current location b of the emergency vehicle E, and the status information includes a traveling direction, a traveling speed, a traveling acceleration, and the like of the emergency vehicle E. It is assumed that the emergency vehicle prompt application type indicates that an area that the emergency vehicle may reach within 5 minutes on a road on which the emergency vehicle travels is used as the interaction coverage area. The first local TCU may use the current location b of the emergency vehicle E as a start point, and determine, based on the traveling speed, the traveling acceleration, and the like of the emergency vehicle E, that a traveling distance of the emergency vehicle E within 5 minutes is 1 km; and then, with reference to map information and the traveling direction of the emergency vehicle E, determine, as an interaction coverage area of a traffic scenario indicated by the emergency vehicle prompt application type, a geographical area that is within a distance of 1 km from the current location b of the emergency vehicle E and that is in the traveling direction of the emergency vehicle E on the road on which the emergency vehicle travels.

205. The first local TCU determines whether a second area exists.

The first local TCU determines, based on the interaction coverage area and a management area of the first local TCU, whether the second area exists, where the second area is an overlapping area between the interaction coverage area and the management area of the first local TCU. In specific implementation, the first local TCU compares the management area of the first local TCU with the interaction coverage area, to determine whether the overlapping area exists between the management area of the first local TCU and the interaction coverage area. If the overlapping area exists, it indicates that the second area exists, and step 206 is performed to determine the first traffic participant object in the second area. If the overlapping area does not exist, it indicates that the second area does not exist. Because the traffic application type and the first traffic information are initially determined on the first local TCU, step 208 may be performed to determine whether a third area exists, where the third area is an overlapping area between a management area of the second local TCU and the interaction coverage area.

In this embodiment of the present invention, for the management area of the first local TCU, an area that the first local TCU is responsible for managing may be set when the first local TCU is deployed, so as to determine the management area of the first local TCU. A manner of setting a management area of each local TCU may be determined in a manner of determining the management area of the first local TCU. Further, an identifier of each local TCU adjacent to the first local TCU and a management area of each local TCU may be further notified to the first local TCU. For a corresponding global TCU, when a local TCU and a global TCU are deployed, a plurality of local TCUs that the global TCU is responsible for managing and a management area of each local TCU may be notified to the global TCU.

In an optional implementation, when at least one of an identifier or a management area of a local TCU is updated, information may be notified to a local TCU adjacent to the local TCU and a global TCU, so that a local TCU related in the interaction coverage area is more accurately determined. For example, the first local TCU receives an identifier and a management area of a local TCU adjacent to the first local TCU that are sent by the adjacent local TCU, to determine the identifier and the management area of the local TCU adjacent to the first local TCU. For another example, the global TCU receives an identifier and a management area of a local TCU that are sent by at least one local TCU, so that the global TCU determines a corresponding management area of the local TCU.

206. The first local TCU determines the first traffic participant object in the second area.

Optionally, the first local TCU determines, as the first traffic participant object, a communicable object that appears in the second area within a preset time. The preset time may be a period of time starting from a current moment. Because time validity of the first traffic information is different, different preset times may be set for different application types, different traffic information, and different traffic application instances. For example, if the first traffic information is natural disaster information, a traffic participant object that appears in the second area within 3 hours and 5 hours counting from a current moment may be determined as the first traffic participant object. For another example, if the first traffic information is traffic signal light information, a traffic participant object that appears in the second area within remaining duration (30 seconds, 50 seconds, and the like) in which a signal light does not change from a current moment may be determined as the first traffic participant object.

Optionally, the communicable object is a vehicle-mounted terminal, a user terminal, a roadside monitoring device, a vehicle, a traffic signal light monitoring device, or the like.

Further, after step 205 and step 206 are performed, step 208 may be further performed to determine whether a third area exists, where the third area is an overlapping area between the management area of the second local TCU and the interaction coverage area.

207. The first local TCU provides interactive support for the first traffic participant object.

The interactive support herein may include sending the first traffic information to the first traffic participant object, or receiving second traffic information sent by the first traffic participant object and sending the second traffic information to the traffic target object. For details, refer to detailed descriptions in FIG. 3*a* and FIG. 3*b*.

Optionally, the first local TCU may determine, based on the traffic application type, to provide interactive support for the first traffic participant object. For example, if the traffic application type is indicating a to-be-processed traffic signal light information notification scenario, used interactive support is sending the first traffic information to the first traffic participant object; or if the traffic application type is indicating a to-be-processed blind area object alarm scenario, used interactive support is receiving the second traffic information sent by the first traffic participant object and sending the second traffic information to the traffic target object.

208. The first local TCU determines whether the third area exists.

The first local TCU determines, based on the interaction coverage area and the management area of the local TCU adjacent to the first local TCU, whether the third area exists, where the third area is an overlapping area between the interaction coverage area and the management area of the local TCU adjacent to the first local TCU. The first local TCU may determine a local TCU adjacent to the first local TCU and a management area of the adjacent local TCU.

In a possible implementation scenario, when there is one TCU adjacent to the first local TCU, for ease of understanding, the TCU adjacent to the first local TCU is named a second local TCU.

The first local TCU compares a management area of the second local TCU with the interaction coverage area, to determine whether an overlapping area exists. If the overlapping area exists, it indicates that the third area exists, and step 209 is performed to send the traffic application type and the first traffic information to the second local TCU. If the third area exists, in addition to step 209, step 215 may be performed, to be specific, the first local TCU determines whether a first area exists. When the third area exists, an execution sequence of step 209 and step 215 is not limited in this embodiment of the present invention. If the overlapping area does not exist, it indicates that the third area does not exist, and step 215 is performed, to be specific, the first local TCU determines whether the first area exists, to determine whether the interaction coverage area further relates to a local TCU other than the first local TCU and the second local TCU.

In another possible implementation scenario, when there are a plurality of local TCUs adjacent to the first local TCU, for ease of understanding, the plurality of TCUs adjacent to the first local TCU are named a plurality of second local TCUs.

In a specific implementation process, first, the first local TCU compares a management area of each of the plurality of second local TCUs with the interaction coverage area to determine whether an overlapping area exists between each second local TCU and the interaction coverage area. Then, it is determined whether there is a second local TCU in the plurality of second local TCUs that has an overlapping area with the interaction coverage area. If there is a second local TCU in the plurality of second local TCUs that has an overlapping area with the interaction coverage area, it indicates that the third area exists, and the first local TCU determines that the second local TCU that has an overlapping area with the interaction coverage area, and performs step 209 on the second local TCU that has an overlapping area with the interaction coverage area to send the traffic application type and the first traffic information. It should be noted herein that the first local TCU does not perform step 209 on a second local TCU that does not have an overlapping area with the interaction coverage area. When the third area exists, in addition to step 209, step 215 may be performed, and the first local TCU determines whether the first area exists. When the third area exists, an execution sequence of step 209 and step 215 is not limited in this embodiment of the present invention. If there is no second local TCU in the plurality of second local TCUs that has an overlapping area with the interaction coverage area, it indicates that the third area does not exist, and step 215 is performed to determine whether the first area exists, to determine whether the interaction coverage area further relates to a local TCU other than the first local TCU and the second local TCU.

209. The first local TCU sends the traffic application type and the first traffic information to the second local TCU.

210. The second local TCU receives the traffic application type and the first traffic information that are sent by the first local TCU.

For step 209 and step 210, after the first local TCU initially determines the traffic application type and the first traffic information of the traffic target object, the first local TCU sends the determined traffic application type and first traffic information of the traffic target object to the second local TCU.

Optionally, after receiving the traffic application type and the first traffic information, the second local TCU may send, to the first local TCU, a message indicating that receiving of the traffic application type and the first traffic information has been acknowledged. Correspondingly, the first local TCU receives the information that indicates the acknowledgement of receiving, so that the first local TCU determines that the second local TCU has acknowledged receiving of the traffic application type and the first traffic information.

In a possible implementation scenario, the first local TCU may create, based on the traffic application type and the first traffic information of the traffic target object, a traffic application instance corresponding to the traffic application, and allocate an instance identifier to the traffic application instance. It should be noted that in this implementation scenario, the first local TCU may further send, to the second local TCU, the instance identifier allocated when the traffic application instance is created. Therefore, when creating the traffic application instance, the second local TCU does not need to allocate a new instance identifier.

It should be noted herein that a specific implementation process of creating the traffic application instance by the second local TCU is different from that of creating the traffic application instance by the first local TCU. In the process of creating the traffic application instance by the second local TCU, the second local TCU determines, based on the traffic application type, a traffic application for which an instance needs to be created, and configures a received instance identifier and first traffic information for the created instance, to create the traffic application instance. Optionally, the second local TCU allocates a physical resource, such as a memory resource, a processing unit (CPU) resource, and a storage resource, to the traffic application instance.

For example, information sent by the first local TCU to the second local TCU includes an instance identifier: N1, an application type: an emergency vehicle prompt application, first traffic information: the current location b of the emergency vehicle E, and status information, where the status information includes a traveling direction, a traveling speed, a traveling acceleration, and the like of the emergency vehicle E. The second local TCU creates an emergency vehicle prompt application instance based on the information, where an instance identifier of the instance is N1, and traffic information referenced by the emergency vehicle prompt application instance is first traffic information.

211. The second local TCU determines that the traffic application type and the first traffic information are not initially determined by the second local TCU.

For the second local TCU, step 210 is used to determine that the second local TCU determines the traffic application type and the first traffic information based on the received information sent by the first local TCU. Therefore, it is determined that the traffic application type and the first traffic information are not initially created by the second local TCU. This step is an optional step.

It should be noted that in this embodiment of the present invention, if the second local TCU determines the traffic application type and the first traffic information by receiving a traffic application type and first traffic information that are sent by the first local TCU or another TCU, it may be determined that the traffic application type and the first traffic information are not initially determined by the second local TCU, and further, step 212 to step 214 in this embodiment of the present invention are performed on a side of the second local TCU.

212. The second local TCU determines the interaction coverage area based on the traffic application type and the first traffic information.

A specific process in which the second local TCU determines the interaction coverage area based on the traffic application type and the first traffic information is the same as a specific process in which the first local TCU determines the interaction coverage area based on the traffic application type and the first traffic information in step 204. A difference between the two processes lies only in: The interaction coverage area is determined by using different TCUs. For details, refer to the detailed description in step 204. Details are not described herein again.

213. The second local TCU determines the second traffic participant object.

The second local TCU is a second local TCU that is determined by the first local TCU from a plurality of local TCUs adjacent to the first local TCU and that has an overlapping area with the interaction coverage area. Therefore, the second local TCU in step 210 to step 214 necessarily has an overlapping area with the interaction coverage area.

Further, the second local TCU may first determine an overlapping area between the management area of the second local TCU and the interaction coverage area, namely, the third area. Then, the second local TCU determines the second traffic participant object in the third area. For a specific implementation in which the second local TCU determines the second traffic participant object in the third area, refer to detailed descriptions of determining the first traffic participant object in the second area by the first local TCU in step 206. Details are not described herein again.

214. The second local TCU provides interactive support for the second traffic participant object.

The interactive support herein may include sending the first traffic information to the second traffic participant object, or receiving second traffic information sent by the second traffic participant object and sending the second traffic information to the traffic target object. For details, refer to detailed descriptions in FIG. 3*a* and FIG. 3*b*.

Optionally, the second local TCU may determine, based on the traffic application type, to provide interactive support for the second traffic participant object. For example, if the traffic application type is indicating a to-be-processed traffic signal light information notification scenario, used interactive support is sending the first traffic information to the second traffic participant object; or if the traffic application type is indicating a to-be-processed blind area object alarm scenario, used interactive support is receiving the second traffic information sent by the second traffic participant object and sending the second traffic information to the traffic target object.

Further, the second local TCU no longer transmits the traffic application type and the first traffic information to any TCU.

215. The first local TCU determines whether the first area exists.

The first local TCU determines, based on the interaction coverage area, the management area of the first local TCU, and the management area of the second local TCU, whether the first area exists. The second local TCU is a local TCU adjacent to the first local TCU, the first area is at least one overlapping area between a management area of a third local TCU and the interaction coverage area and the interaction coverage area, and the third local TCU is a local TCU not adjacent to the first local TCU.

In specific implementation, after the first local TCU separately compares the interaction coverage area with the management area of the first local TCU and the management area of the second local TCU, to determine whether an overlapping area exists, the first local TCU may determine whether there is another area other than the determined overlapping area in the interaction coverage area.

If there is still another area, it indicates that the interaction coverage area includes the first area that neither belongs to the management area of the first local TCU and nor belongs to the corresponding management area of the second local TCU, in other words, the first area is an overlapping area between the management area of the at least one third local TCU and the interaction coverage area. It should be noted that the first local TCU may determine whether the first area exists without determining the management area of the at least one third local TCU. Further, because the global TCU may determine management areas of a plurality of local TCUs, the first local TCU performs step 216 to send the traffic application type and the first traffic information to the global TCU, so that the global TCU determines another local TCU related in the interaction coverage area.

If the another area does not exist, it indicates that the interaction coverage area is not beyond a target management area, and the target management area includes the management area of the first local TCU and the management area of the second local TCU. In this case, the first local TCU further does not perform another step.

216. The first local TCU sends the traffic application type and the first traffic information to the global TCU.

217. The global TCU receives the traffic application type and the first traffic information that are sent by the first local TCU.

For step 209 and step 210, after the first local TCU initially determines the traffic application type and the first traffic information of the traffic target object, the first local TCU sends the determined traffic application type and first traffic information of the traffic target object to the global TCU.

Optionally, after the global TCU receives the traffic application type and the first traffic information, the global TCU may send, to the first local TCU, a message indicating that receiving of the traffic application type and the first traffic information has been acknowledged. Correspondingly, the first local TCU receives the information that indicates the acknowledgement of receiving, so that the first local TCU determines that the global TCU has acknowledged receiving of the traffic application type and the first traffic information.

In a possible implementation scenario, the first local TCU may create, based on the traffic application type and the first traffic information of the traffic target object, a traffic application instance corresponding to the traffic application, and allocate an instance identifier to the traffic application instance. It should be noted that in this implementation scenario, the first local TCU may further send, to the global TCU, the instance identifier allocated when the traffic application instance is created. Therefore, when creating the traffic application instance, the global TCU does not need to allocate a new instance identifier.

It should be noted herein that a specific implementation process of creating the traffic application instance by the global TCU is different from that of creating the traffic application instance by the first local TCU. In the process of creating the traffic application instance by the global TCU, the global TCU determines, based on the traffic application type, a traffic application for which an instance needs to be created, and configures a received instance identifier and first traffic information for the created instance, to create the traffic application instance. Optionally, the global TCU allocates a physical resource, such as a memory resource, a processing unit (CPU) resource, and a storage resource, to the traffic application instance.

218. The global TCU determines that the traffic application type and the first traffic information are not initially determined by the global TCU.

For the global TCU, step 217 is used to determine that the global TCU determines the traffic application type and the first traffic information based on the received information sent by the first local TCU. Therefore, it is determined that the traffic application type and the first traffic information are not initially created by the global TCU. This step is an optional step.

It should be noted that in this embodiment of the present invention, if the global TCU determines the traffic application type and the first traffic information by receiving a traffic application type and first traffic information that are sent by the first local TCU or another local TCU, it may be determined that the traffic application type and the first traffic information are not initially determined by the global TCU, and further, step 219 to step 221 in this embodiment of the present invention are performed on a side of the global TCU.

219. The global TCU determines the interaction coverage area based on the traffic application type and the first traffic information.

A specific process in which the global TCU determines the interaction coverage area is the same as a specific process in which the first local TCU determines the interaction coverage area in step 204. A difference between the two processes lies only in: The interaction coverage area is determined by using different TCUs. For details, refer to the detailed description in step 204. Details are not described herein again.

220. The global TCU determines a target local TCU based on the interaction coverage area and a management area of at least one local TCU.

First, the target local TCU meets a first condition: There is an overlapping area between a management area of the target local TCU and the interaction coverage area, so that a local TCU whose management area that has an overlapping area with the interaction coverage area processes the to-be-processed traffic scenario.

Then, on the basis of meeting the first condition, the target local TCU further needs to meet a second condition: The target local TCU does not include the first local TCU and a local TCU adjacent to the first local TCU, because the management area of the global TCU is divided into management areas of all local TCUs in the at least one local TCU. The at least one local TCU includes the first local TCU, the second local TCU, and other local TCUs. Herein, the other local TCUs are named a plurality of fifth local TCUs for ease of understanding. Whether the first local TCU and the second local TCU have overlapping areas with the interaction coverage area has been determined by the first local TCU. Therefore, the determined target local TCU does not include the first local TCU and the second local TCU of the first local TCU. In an optional implementation, the global TCU may exclude the first local TCU and the local TCU adjacent to the first local TCU in the at least one local TCU to obtain a plurality of fifth local TCUs, and may determine, from the plurality of fifth local TCUs, a target local TCU whose management area has an overlapping area with the interaction coverage area. In another optional implementation, the global TCU determines, from the at least one local TCU, a plurality of sixth local TCUs whose management area has an overlapping area with the interaction coverage area, and compares identifiers of the plurality of sixth local TCUs with each of identifiers of the first local TCU and the local TCU adjacent to the first local TCU, to obtain a local TCU that does not include the first local TCU and the local TCU adjacent to the first local TCU.

221. The global TCU sends the traffic application type and the first traffic information to the target local TCU.

Correspondingly, the target local TCU receives the traffic application type and the first traffic information. For specific implementation of processing the traffic application type and the first traffic information by the target local TCU, refer to detailed descriptions of step 210 to step 214 performed by the second local TCU. Details are not described herein again.

Optionally, after the target local TCU receives the traffic application type and the first traffic information, the target local TCU may send, to the global TCU, a message indicating that receiving of the traffic application type and the first traffic information has been acknowledged. Correspondingly, the global TCU receives the information that indicates the acknowledgement of receiving, so that the global TCU determines that the target local TCU has acknowledged receiving of the traffic application type and the first traffic information.

Figure 3A:
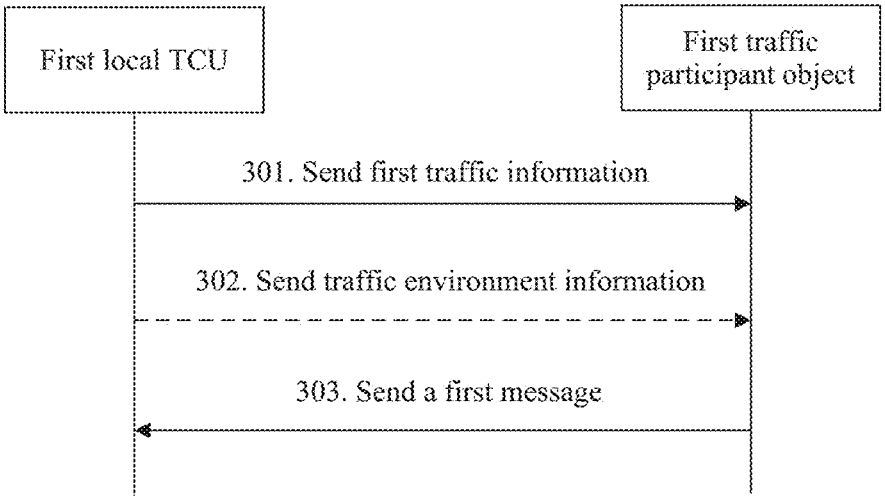
FIG. 3*a* is a schematic flowchart of providing interactive support according to an embodiment of the present invention.
Figure 3B:
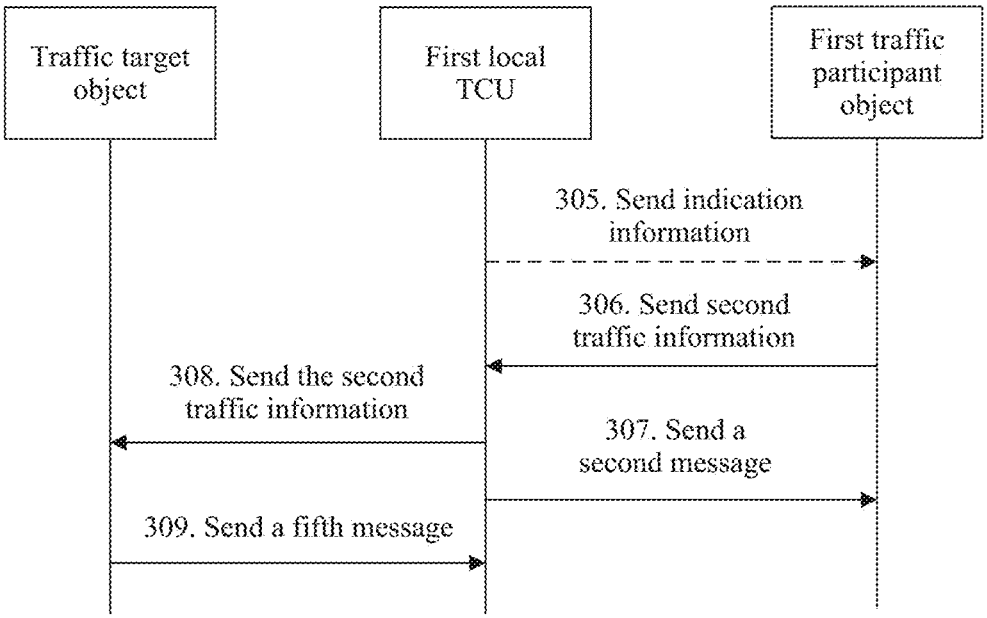
FIG. 3*b* is a schematic flowchart of providing interactive support according to an embodiment of the present invention.

In this embodiment of the present invention, regardless of step 207 in which the first local TCU provides interactive support for the first traffic participant object or step 214 in which the second local TCU provides interactive support for the second traffic participant object, refer to any implementation in FIG. 3*a* and FIG. 3*b*. FIG. 3*a* and FIG. 3*b* are described by using an example in which the first local TCU provides interactive support for the first traffic participant object. For details, refer to the following descriptions.

In an optional implementation, FIG. 3*a* is a schematic flowchart of providing interactive support according to an embodiment of the present invention. As shown in FIG. 3*a*, the schematic diagram is jointly performed by the first local TCU and the first traffic participant object, and specifically includes step 301 to step 303.

301. The first local TCU sends first traffic information to a first traffic participant object.

In step 202 in which the first local TCU determines the traffic application type and the first traffic information, it may be learned that the first traffic information may be obtained in different manners. Details are not described herein again. The first traffic information is sent to the first traffic participant object, so that the first traffic information is effectively used by the first traffic participant object.

For example, if the first traffic information is location information of forward congestion, and the first traffic participant object is a nearby vehicle, the first local TCU may send the location information of the forward congestion to the nearby vehicle, so that after the first traffic participant object receives the information, a user of the vehicle may determine, based on a location and a requirement of the user, whether to adjust a traveling path.

In a possible implementation scenario, the first traffic information sent by the first local TCU is first traffic information processed by the first local TCU. For example, if the first traffic information is location information and status information of a traffic signal light S, and the status information herein is that remaining duration within which the signal light S remains a red light is 45 seconds, the first local TCU may generate the first traffic information based on the received first traffic information and information processing duration, for example, the information processing duration includes duration of determining the interaction coverage area, duration of determining the first traffic participant object, and transmission duration of transmitting information with the first traffic participant object. If the information processing duration is 5 s, the generated first traffic information is the location information of the signal light S and the status information in which the remaining duration of remaining the red light is 40 seconds.

Correspondingly, the first traffic participant object receives the first traffic information.

302. The first local TCU sends traffic environment information to the first traffic participant object.

The first local TCU may obtain the traffic environment information, and send the traffic environment information to the first traffic participant object. The traffic environment information may include but is not limited to weather information, information about whether there is water on a traffic road, or the like. Optionally, the first local TCU may obtain weather information from a weather monitoring device, and may obtain, from a road monitoring device, information about whether there is water on a traffic road.

Correspondingly, the first traffic participant object receives the traffic environment information.

Optionally, the first local TCU may further send traffic difference information different from the first traffic information to the first traffic participant object. The traffic difference information herein is not limited to the traffic environment information in step 302. In an optional implementation, after the first local TCU determines to send the first traffic information and the traffic difference information, the first local TCU may send the first traffic information and the traffic difference information to the first traffic participant object once; or separately send the first traffic information and the traffic difference information twice. This is not limited in this embodiment of the present invention.

303. The first traffic participant object sends a first message to the first local TCU.

The first message is used to indicate that the first traffic participant object has acknowledged receiving of the first traffic information. Correspondingly, the first local TCU receives the first message, so that the first local TCU determines that the first traffic participant object has acknowledged receiving of the sent information.

In another optional implementation, FIG. 3*b* is a schematic flowchart of providing other interactive support according to an embodiment of the present invention. As shown in FIG. 3*b*, the schematic diagram is jointly performed by the first local TCU, the first traffic participant object, and the traffic target object, and specifically includes step 305 to step 309.

305. The first local TCU sends indication information to the first traffic participant object.

Step 305 is an optional step, and the indication information is sent, so that the first traffic participant object feeds back second traffic information.

306. The first traffic participant object sends the second traffic information to the first local TCU.

The first traffic participant object may send the second traffic information to the first local TCU regardless of whether the indication information is received. The first traffic participant object may also be a moving object or a fixed object. The second traffic information may include location information of the first traffic participant object; or the second traffic information includes location information and status information of the first traffic participant object, for example, the status information includes a direction, a speed, an acceleration, and an angular velocity.

307. The first local TCU sends a second message to the first traffic participant object.

After receiving the second traffic information, the first local TCU may send the second message to the first traffic participant object, where the second message is used to indicate that the traffic participant object has acknowledged receiving of the second traffic information.

Correspondingly, the first traffic participant object receives the second message to determine that the first local TCU has acknowledged receiving of the second traffic information.

308. The first local TCU sends the second traffic information to the traffic target object.

The first local TCU may send the received second traffic information to the traffic target object, so that the traffic target object effectively uses the information. For example, if the traffic target object is a first vehicle at an intersection with a high collision occurrence rate, the first traffic participant object is a second vehicle within a specific distance from the first vehicle, and in order to reduce collision, the first local TCU may send location information and status information of the second vehicle to the first vehicle, so that a user of the first vehicle can know information about other vehicles at the intersection in a timely manner, and can also adjust driving behavior of the user based on actual needs.

For example, when the first local TCU receives the traffic application type and the first traffic information of the traffic target object that are sent by a local TCU (set to the third local TCU) adjacent to the first local TCU, the first local TCU may send the second traffic information to the traffic target object by using the third local TCU. If the third local TCU also receives a traffic application type and first traffic information of the traffic target object that are sent by a fourth local TCU adjacent to the third local TCU, the second traffic information may be further transmitted by using the fourth local TCU to the traffic target object.

309. The traffic target object sends a fifth message to the first local TCU.

After receiving the second traffic information, the traffic target object may send the fifth message to the first local TCU, where the fifth message is used to indicate that the traffic target object has acknowledged receiving of the second traffic information.

Correspondingly, the first local TCU receives the fifth message to determine that the traffic target object has acknowledged receiving of the second traffic information.

In this embodiment of the present invention, step 307 and step 308 are not successively performed.

It should be noted in the embodiment shown in FIG. 3*b* that, for step 207 in which the first local TCU provides interactive support for the first traffic participant object, in other words, both the first traffic participant object and the traffic target object are located in the management area of the first local TCU, the first local TCU may complete execution of step 308 in which the first local TCU sends the second traffic information to the traffic target object. For step 214 in which the second local TCU provides interactive support for the second traffic participant object, in this case, the traffic target object is located in the management area of the first local TCU, and the second traffic participant object is located in the management area of the second local TCU. The second local TCU may first send the second traffic information to the first local TCU, and the first local TCU sends the second traffic information to the traffic target object.

To be specific, when the first traffic participant object and the traffic target object are located in management areas of different local TCUs, the second traffic information may be jointly sent to the traffic target object by using these different local TCUs. For example, the second local TCU in which the first traffic participant object is located sends the second traffic information to a sender of the traffic application type and the first traffic information, namely, the first local TCU, and then the first local TCU sends the second traffic information to the traffic target object. Alternatively, a local TCU in which the first traffic participant object is located may send the second traffic information to the global TCU, and then the global TCU sends the second traffic information to the traffic target object. Alternatively, a local TCU in which the first traffic participant object is located may send the second traffic information to the global TCU, then the global TCU sends the second traffic information to the local TCU in which the traffic target object is located, and finally, the local TCU in which the traffic target object is located sends the second traffic information to the traffic target object. This is not limited in this embodiment of the present invention.

In this embodiment of the present invention, when the first local TCU initially determines the traffic application type and the first traffic information of the traffic target object, the first local TCU can determine a interaction coverage area, and can determine whether the interaction coverage area has overlapping areas with the first local TCU and a local TCU adjacent to the first local TCU. In addition, the traffic application type and the first traffic information may be sent to the global TCU, so that the global TCU determines another local TCU that has an overlapping area with the interaction coverage area. In this way, the interaction coverage area may be purposefully determined based on a traffic scenario, and a traffic participant object related in the interaction coverage area may be accurately determined and provided with interactive support, to purposefully transfer traffic information. Through division of processing of traffic information by a local TCU and a global TCU, waste of communication and processing resources caused by broadcasting traffic information in a large range is reduced.

The traffic information processing method of the embodiment shown in FIG. 2A, FIG. 2B, and FIG. 2C is described by using examples below for some actual application scenarios. An implementation scenario in FIG. 3*a* is used as an example herein. Interactive support provided by the first local TCU for the first traffic participant object is for notifying the first traffic participant object of the first traffic information of the traffic target object, where the traffic target object may be a fixedly deployed or relatively fixed object, or may be a moving object.

A traffic information processing method of a fixedly deployed traffic target object is described by using a traffic signal light information notification application type as an example.

Figure 4:
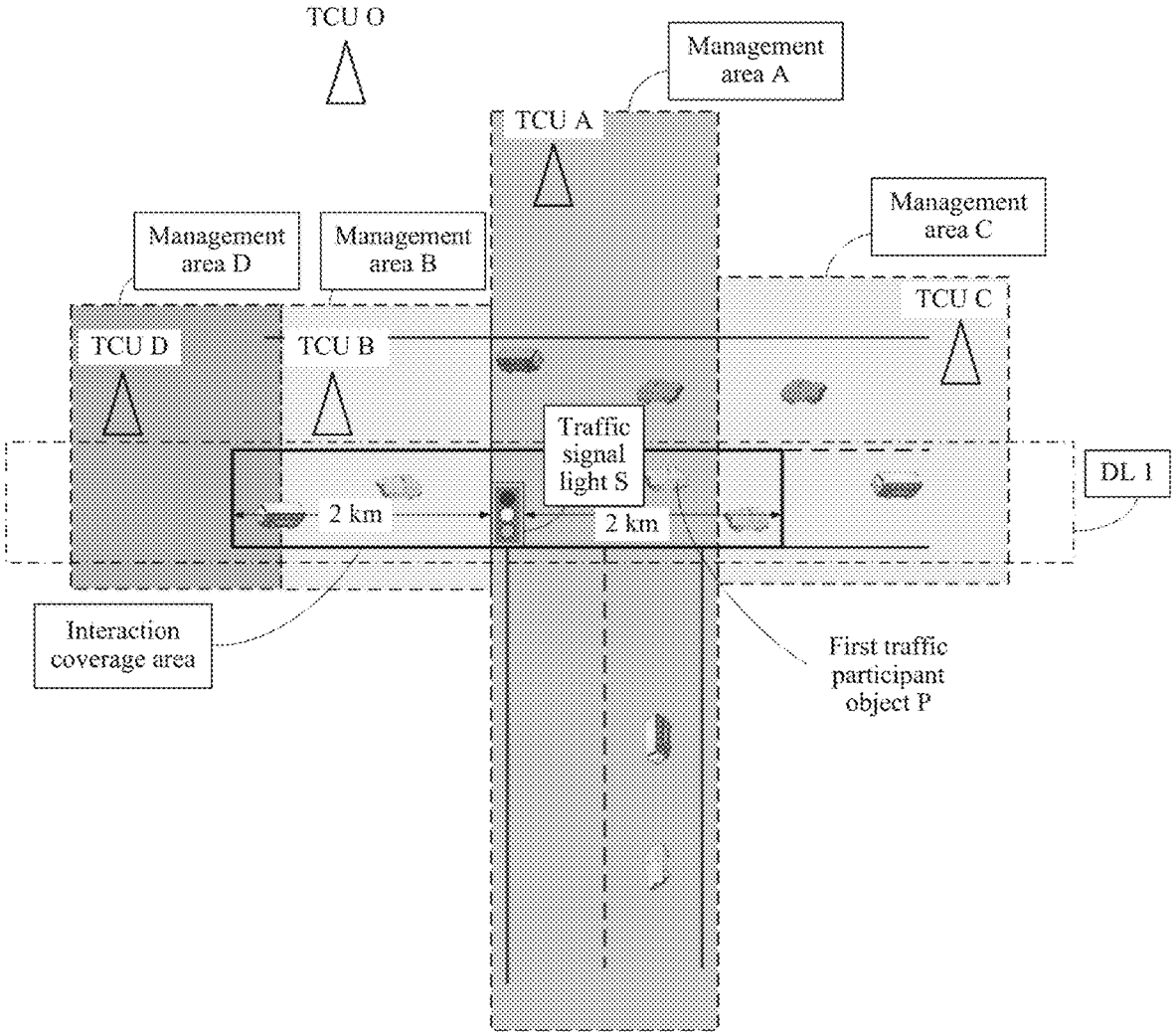
FIG. 4 is a diagram of an example of a traffic information processing method according to an embodiment of the present invention.

As shown in FIG. 4, the global TCU is a TCU O, and may communicate with each local TCU. Local TCUs are a TCU A, a TCU B, a TCU C, and a TCU D and are respectively responsible for a management area A, a management area B, a management area C, and a management area D.

A traffic signal light S is fixedly deployed in an area for which the TCU A is responsible. A control unit of the traffic signal light S sends information about the traffic signal light S (namely, the first traffic information in the foregoing embodiment) to the TCU A actively or after the TCU A requests. The information about the traffic signal light S may include an identifier, location information, and current phase status information of the traffic signal light S. The phase status information may include a type of a current signal such as passing, stopping, deceleration, speed limiting, and turning, and remaining duration of the current signal. The TCU A may feed back, to the control unit of the traffic signal light S, a message used to indicate that receiving of the information about the traffic signal light S has been acknowledged.

The information about the traffic signal light S triggers the TCU A to determine a traffic application type based on the information about the traffic signal light S, and the traffic signal light S is used as a traffic target object. The TCU A determines an interaction coverage area based on the traffic signal light information notification application type and the information about the traffic signal light S with reference to map information. It is assumed that the traffic signal light information notification application type indicates that an area that is on a road controlled by a traffic signal light and that is within a distance of 2 km from the traffic signal light is used as an interaction coverage area, and the TCU A may use a location of the traffic signal light S as a start point and determine a road area DL 1 that is shown in FIG. 4, that is controlled by the traffic signal light S, and that is within a distance of 2 km from the traffic signal light S, as a determined interaction coverage area.

It may be learned that if there is an overlapping area between the management area A of the TCU A and the interaction coverage area, in other words, a second area exists, the TCU A further determines a first traffic participant object P (a vehicle in FIG. 4) that is actually related in the interaction in the management area A of the TCU A. Based on the traffic signal light information notification application type, an interactive support method used by the TCU A may be: sending the information about the traffic signal light S to the first traffic participant object P, so that the first traffic participant object P moves based on the traffic signal light S, for example, passes, stops, turns, or adjusts a speed. The first traffic participant object P may feed back, to the TCU A, a message used to indicate that receiving of the information about the traffic signal light S has been acknowledged.

Further, the TCU A may determine a management area of the local TCU B and a management area of the local TCU C, and further determine that there is an overlapping area between the interaction coverage area and each of the management area B and the management area C, in other words, a third area exists.

The TCU A sends the traffic application type and the first traffic information of the traffic target object to the TCU B and the TCU C. When the TCU B or the TCU C receives the traffic application type and the first traffic information of the traffic target object that are transmitted by the TCU A, the TCU B and the TCU C separately process the traffic application type and the first traffic information of the traffic target object. The TCU B or the TCU C may reply to the TCU A with a message used to indicate that receiving of the traffic application type and the first traffic information of the traffic target object has been acknowledged. A procedure of the TCU B and the TCU C for processing the traffic application type and the first traffic information of the traffic target object is the same as the processing procedure of the foregoing TCU A, but the TCU B or the TCU C no longer transmits the traffic application type and the first traffic information of the traffic target object to any TCU.

Further, the TCU A may determine overlapping areas with the TCU A, the TCU B, and the TCU C in the interaction coverage area, and other areas in the interaction coverage area are still not determined. In this case, the TCU A sends the traffic application type and the first traffic information of the traffic target object to the TCU O. The TCU O determines TCUs except the TCU A, TCU B, and TCU C that have overlapping areas with the interaction coverage area. As shown in FIG. 4, the interaction coverage area further has an overlapping area with the TCU D, in other words, a first area exists. Therefore, the TCU O determines the TCU D as a target local TCU, and sends the traffic application type and the first traffic information of the traffic target object to the TCU D, so that the TCU D processes the traffic application type and the first traffic information of the traffic target object. When the TCU D receives the traffic application type and the first traffic information of the traffic target object that are transmitted by the TCU O, the TCU D may reply to the TCU O with a message used to indicate that receiving of the traffic application type and the first traffic information of the traffic target object has been acknowledged. A procedure of the TCU D for processing the traffic application type and the first traffic information of the traffic target object is the same as the processing procedure of the foregoing TCU A, but the TCU D no longer transmits the traffic application type and the first traffic information of the traffic target object to any TCU.

Similarly, in an in-vehicle label display application, a fixedly deployed traffic sign is used as a traffic target object, and a control unit of the traffic sign sends information about the traffic sign to a local TCU. The interaction coverage area includes an area on a road that the traffic sign is responsible for controlling and within a specific distance or a specific quantity of intersections from the traffic sign. The local TCU sends the information about the traffic sign to the first traffic participant object in the interaction coverage area, so that the first traffic participant object can display the information about the traffic sign in a vehicle after receiving the information about the traffic sign.

In a forward congestion prompt application, a suddenly appearing congestion reporting point is used as a traffic target object, and congestion report information is sent to the local TCU by a nearby roadside monitoring device, a passing vehicle, a passing vehicle user, a pedestrian, or the like. The interaction coverage area includes an area that is on a road connected around the congestion reporting point, that is in a direction to approach the congestion reporting point, and that is within a specific distance or a specific quantity of intersections from the congestion reporting point. The local TCU sends the congestion report information to the first traffic participant object in the interaction coverage area, so that the first traffic participant object can adjust a traveling path after receiving the congestion report information.

In a dangerous obstacle alarm application, a suddenly appearing road obstacle is used as a traffic target object, and information about the road obstacle is sent to the local TCU by a nearby roadside monitoring device, a passing vehicle, a passing vehicle user, a pedestrian, or the like. The interaction coverage area includes an area that is on a road in which the obstacle is located, that is in a direction to approach the obstacle, and that is within a specific distance or a specific quantity of intersections from the obstacle. The local TCU sends the information about the road obstacle to the first traffic participant object in the interaction coverage area, so that the first traffic participant object is vigilant against the obstacle during traveling after receiving the information about the road obstacle.

A traffic information processing method of a moving traffic target object is described by using an emergency vehicle prompt application type as an example.

An emergency vehicle E moves in the management area A of the TCU A. Information about the emergency vehicle E (namely, the first traffic information in the foregoing embodiment) is sent to the TCU A by the emergency vehicle E or after a nearby roadside monitoring device discovers the emergency vehicle E. The information about the emergency vehicle E may include an identifier, a current location, and a motion status of the emergency vehicle E. The motion status may include a direction, a speed, an acceleration, an angular velocity, and the like. The TCU A may reply to the emergency vehicle E or the nearby roadside monitoring device with a message used to indicate that receiving of the information about the emergency vehicle E has been acknowledged.

The information about the emergency vehicle E triggers the TCU A to determine the traffic application type based on the information about the emergency vehicle E, where the traffic target object is the emergency vehicle E. The TCU A determines an interaction coverage area based on the emergency vehicle prompt application type and the information about the emergency vehicle E with reference to map information. The interaction coverage area includes an area that is on a road ahead of traveling of the emergency vehicle E and that is within a specific distance (for example, 300 m) from a current location of the emergency vehicle E. The TCU A determines a related TCU based on the interaction coverage area with reference to an area for which a TCU is responsible and that is known by the TCU If there is an overlapping area between the management area A of the TCU A and the interaction coverage area, in other words, the second area exists, the TCU A further determines the first traffic participant object P that is actually related in the interaction in the management area of the TCU A, and the first traffic participant object P may be a vehicle, a vehicle user, and/or a roadside infrastructure. According to the emergency vehicle prompt application type, the interactive support method used by the TCU A may be: sending the information about the emergency vehicle E to the first traffic participant object P so that the first traffic participant object P provides convenience for traveling of the emergency vehicle E. For example, a vehicle on a road ahead of traveling of the emergency vehicle E gives way to the emergency vehicle E, or a roadside infrastructure such as a traffic signal on a road ahead of traveling of the vehicle adjusts a phase state for the emergency vehicle E. The first traffic participant object P may reply to the TCU A with a message used to indicate that receiving of the information about the emergency vehicle E has been acknowledged.

Further, if there is an overlapping area between the interaction coverage area and the management area of a TCU adjacent to the TCU A, the third area exists. It is assumed that the TCU that is adjacent to the TCU A and that has an overlapping area with the interaction coverage area is the TCU E. The TCU A sends an emergency vehicle prompt application type and the information about the emergency vehicle E to the TCU E. When the TCU E receives the emergency vehicle prompt application type and the information about the emergency vehicle F that are transmitted by the TCU A, the TCU E may reply to the TCU A with a message used to indicate that receiving of the emergency vehicle prompt application type and the information about the emergency vehicle E has been acknowledged. A procedure of the TCU E for processing the emergency vehicle prompt application type and the information about the emergency vehicle E is the same as the processing procedure of the foregoing TCU A, but the first local TCU no longer transmits the emergency vehicle prompt application type and the information about the emergency vehicle E to any TCU.

Similarly, in an abnormal vehicle alarm application, an abnormal vehicle that suddenly appears and that may move is used as a traffic target object, and information about the abnormal vehicle is sent to a local TCU by the abnormal vehicle, a nearby roadside monitoring device, a passing vehicle, a passing vehicle user, a pedestrian, or the like. The interaction coverage area includes an area that is on a road in the rear of traveling of the abnormal vehicle and that is within a specific distance from the abnormal vehicle. The local TCU sends the information about the abnormal vehicle to the first traffic participant object in the interaction coverage area, so that the first traffic participant object may keep vigilant during traveling after receiving the information about the abnormal vehicle, to avoid collision with the abnormal vehicle.

In a vulnerable traffic participant object warning application, a vulnerable traffic participant object (such as a pedestrian or a rider) that suddenly appears and that may move is a traffic target object, and information about the vulnerable traffic participant object is sent to a local TCU by the vulnerable traffic participant object, a nearby roadside monitoring device, a passing vehicle, a passing vehicle user, a pedestrian, or the like. The interaction coverage area includes an area that is on a road connected around the vulnerable traffic participant object, that is in a direction to approach the vulnerable traffic participant object, and that is within a specific distance from the vulnerable traffic participant object. The local TCU sends the information about the vulnerable traffic participant object to the first traffic participant object in the interaction coverage area, so that the first traffic participant object may keep vigilant during traveling forward, traveling backward, or turning after receiving the information about the vulnerable traffic participant object, to avoid collision with the vulnerable traffic participant object.

Figure 5A:
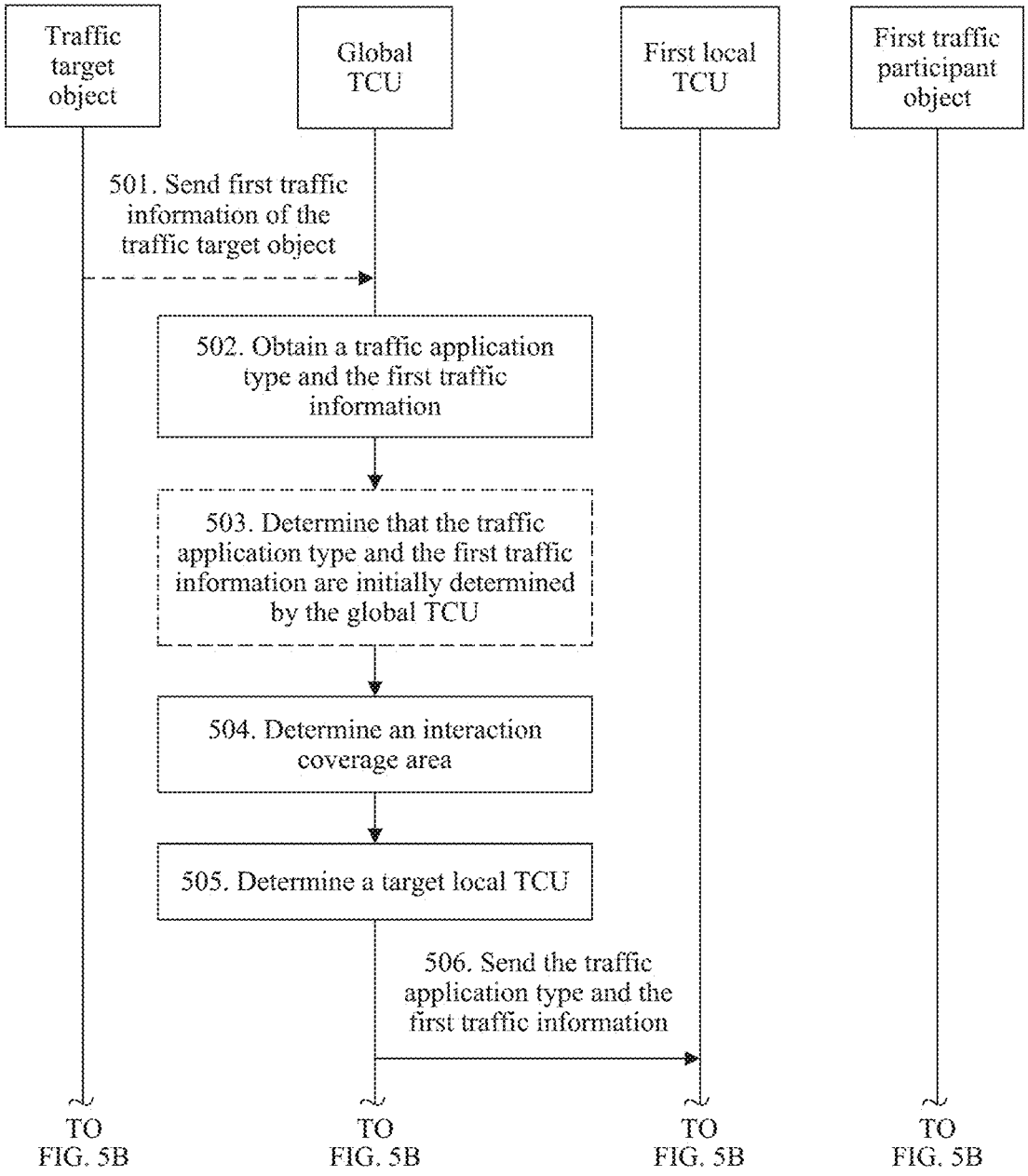
FIG. 5A and FIG. 5B are a schematic flowchart of a traffic information processing method according to an embodiment of the present invention.
Figure 5B:
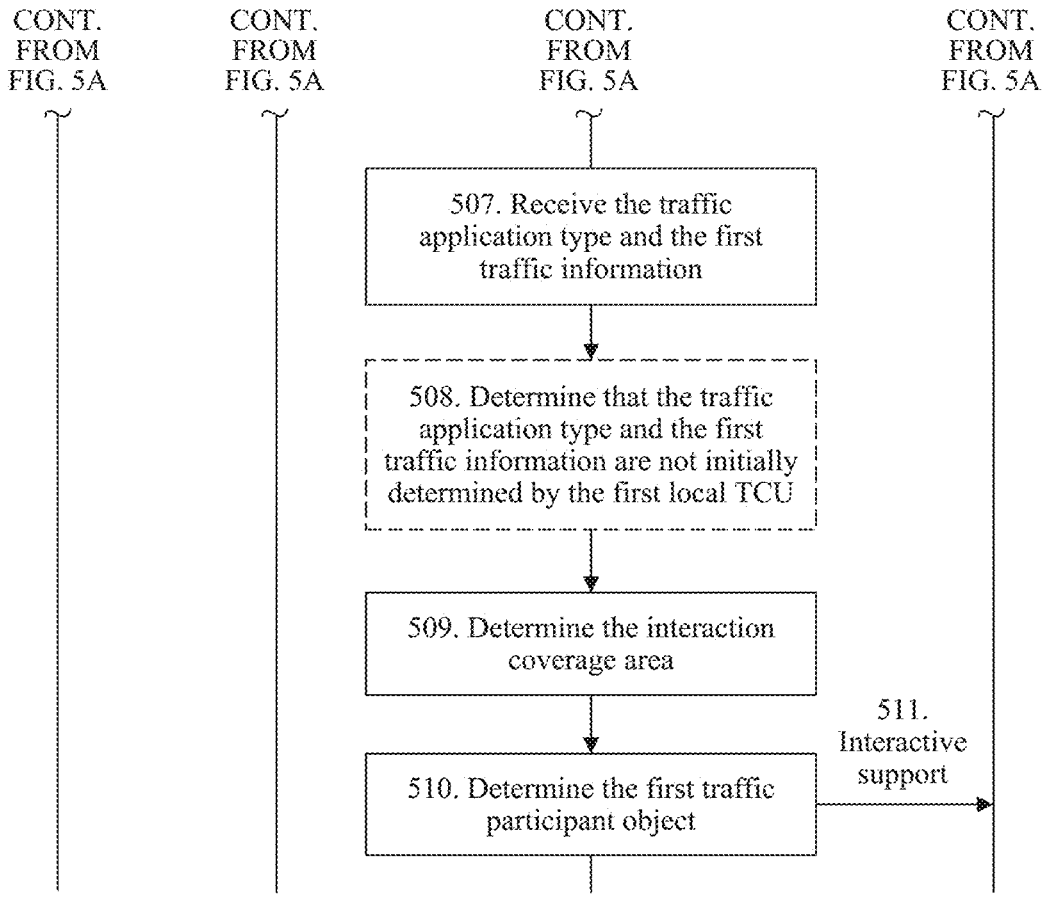

Based on the diagram of the system architecture in FIG. 1, FIG. 5A and FIG. 5B are a schematic flowchart of another traffic information processing method according to an embodiment of the present invention. In this embodiment, a global TCU and a first local TCU are included. A management area of the global TCU is divided into a management area of at least one local TCU, and the management area of the at least one local TCU includes a management area of the first local TCU. The first local TCU is any local TCU in target local TCUs, and the target local TCUs are TCUs determined by the global TCU. As shown in FIG. 5A and FIG. 5B, the traffic information processing method further relates to a traffic target object and a first traffic participant object. The embodiment shown in FIG. 5A and FIG. 5B is a specific implementation on the basis that the global TCU is a TCU that initially obtains a traffic application type and first traffic information.

501. The traffic target object sends first traffic information of the traffic target object to the global TCU.

The first traffic information is information about the traffic target object, where the traffic target object may be an object such as a pedestrian, a vehicle, or a traffic infrastructure. The first traffic information of the traffic target object may include various traffic information related to the traffic target object, for example, may include information about an identifier, a location, and a status of the traffic target object, or may include traffic environment information, disaster information, or the like.

Correspondingly, the global TCU receives the first traffic information sent by the traffic target object.

502. The global TCU obtains a traffic application type and the first traffic information.

503. The global TCU determines that the traffic application type and the first traffic information are initially determined by the global TCU.

504. The global TCU determines an interaction coverage area based on the traffic application type and the first traffic information.

For step 502 to step 504, refer to detailed descriptions of step 202 to step 204 in the embodiment shown in FIG. 24, FIG. 2B, and FIG. 2C. Details are not described herein again.

505. The global TCU determines a target local TCU based on the interaction coverage area and a management area of at least one local TCU.

For example, the global TCU compares the interaction coverage area with each of the management area of the at least one local TCU, and determines a local TCU that has an overlapping area with the interaction coverage area as a target local TCU.

In this embodiment of the present invention, in a process of deploying the global TCU and deploying at least one local TCU, an identifier and a management area of the at least one local TCU within a management range of the global TCU are notified to the global TCU, so that the global TCU may determine the identifier and the management area of the at least one local TCU. Further, in a deployment process, a local TCU adjacent to each local TCU may be further notified to the global TCU. Alternatively, two local TCUs whose management areas are adjacent in a geographical area are determined by the globally TCU as local TCUs that are adjacent to each other.

In an optional implementation, when at least one of an identifier and a management area of a local TCU is updated, information may be notified to the global TCU, so that a local TCU related in the interaction coverage area is more accurately determined. For example, the global TCU receives the identifier and the management area of the first local TCU that are sent by the first local TCU.

506. The global TCU sends the traffic application type and the first traffic information to the first local TCU.

507. The first local TCU receives the traffic application type and the first traffic information that are sent by the global TCU.

The first local TCU herein is any TCU in the target local TCUs determined in step 505. To be specific, the global TCU sends the traffic application type and the first traffic information to each target local TCU, and each target local TCU performs step 507 to step 511 as the first local TCU in this embodiment of the present invention.

Optionally, after the first local TCU receives the traffic application type and the first traffic information, the first local TCU may send, to the global TCU, a message indicating that receiving of the traffic application type and the first traffic information has been acknowledged. Correspondingly, the global TCU receives the information that indicates the acknowledgement of receiving, so that the global TCU determines that the first local TCU has acknowledged receiving of the traffic application type and the first traffic information.

508. The first local TCU determines that the traffic application type and the first traffic information are not initially determined by the first local TCU.

509. The first local TCU determines the interaction coverage area based on the traffic application type and the first traffic information.

510. The first local TCU determines the first traffic participant object.

511. The first local TCU provides interactive support for the first traffic participant object.

For step 508 to step 511, refer to detailed descriptions of step 211 to step 214 in the embodiment shown in FIG. 2A, FIG. 2B, and FIG. 2C. Details are not described herein again.

Further, the first local TCU no longer transmits the traffic application type and the first traffic information to any TCU.

In this embodiment of the present invention, if the traffic application type and the first traffic information of the traffic target object are initially determined by the global TCU, the global TCU can determine the interaction coverage area, and can determine each local TCU that has an overlapping area with the interaction coverage area, so that an interaction coverage area can be purposefully determined based on a traffic scenario. In addition, a local TCU whose management area has an overlapping area with the interaction coverage area may determine a related traffic participant object, to technically support the traffic participant object, and to purposefully transfer traffic information, thereby reducing waste of communication and processing resources caused by broadcasting traffic information in a large range.

The traffic information processing method of the embodiment shown in FIG. 5A and FIG. 5B is described by using examples below for some actual application scenarios. Herein, an implementation scenario in FIG. 3*b* is used as an example. Interaction support provided by the global TCU for the first traffic participant object is collecting second traffic information of the first traffic participant object, and then sending the second traffic information to the traffic target object.

The traffic information processing method in the implementation scenario in FIG. 3*b* is described by using a blind area object alarm application type as an example.

The global TCU is a TCU O, and may communicate with each local TCU. Local TCUs are a TCU A, a TCU B, a TCU C, and a TCU D and are respectively responsible for a management area A, a management area B, a management area C, and a management area D.

A target vehicle V may directly send a blind area object alarm information request to the TCU O (optionally, the target vehicle V may send the blind area object alarm information request to the TCU O when the target vehicle V is uncertain about a management area in which the target vehicle V moves) or the TCU O may be triggered to determine a blind area object alarm application type when the TCU O controls startup. The target vehicle V is used as a traffic target object. The target vehicle V sends information about the target vehicle V (namely, the first traffic information in the foregoing embodiment) to the TCU O. The information about the target vehicle V may include an identifier, a current location, and a motion status of the target vehicle V. The motion status may include a direction, a speed, an acceleration, an angular velocity, and the like.

The TCU O determines an interaction coverage area based on the blind area object alarm application type and the information about the target vehicle V with reference to map information. The interaction coverage area includes an area that is around the target vehicle V, that is not in an observable direction of the target vehicle V, and that is within a specific distance (for example, 100 m) from the target vehicle V. The TCU O determines target local TCUs based on the interaction coverage area and a management area of each local TCU that is known by the TCU O.

If there is an overlapping area between the interaction coverage area and each of the management area A of the TCU A, the management area B of the TCU B, and the management area D of the TCU D, the TCU O determines that the target local TCUs include the TCU A, the TCU B, and the TCU D. The TCU O separately sends a blind area object alarm application type and the information about the target vehicle V to the TCU A, the TCU B, and the TCU D. When the TCU A, the TCU B, or the TCU D receives the blind area object alarm application type and the information about the target vehicle V that are transmitted by the TCU O, the TCU A, the TCU B, or the TCU D may reply to the TCU O with a message used to indicate that receiving of the blind area object alarm application type and the information about target vehicle V has been acknowledged.

The TCU A is used as an example for description. When processing the blind area object alarm application type and the information about target vehicle V, the TCU A determines an overlapping area between the management area A and the interaction coverage area. The TCU A further determines that the overlapping area actually relates to the first traffic participant object P in the interaction. The first traffic participant object P may be a moving or fixed object. Information about the first traffic participant object P (namely, the second traffic information in the foregoing embodiment) is sent to the TCU A by the first traffic participant object P or after a nearby roadside monitoring device discovers the first traffic participant object P or after the TCU A requests from the first traffic participant object. The information about the first traffic participant object P may include a location and a motion status of the first traffic participant object P. The motion status may include a direction, a speed, an acceleration, an angular velocity, and the like. The TCU A sends the information about the first traffic participant object P to the target vehicle V, so that the target vehicle V learns of an object in a blind area of the target vehicle V and is vigilant of collision with the target vehicle V, for example, corrects or gives up movement to the blind area. The target vehicle V may reply to the TCU with a message used to indicate that receiving of the information about the first traffic participant object P has been acknowledged.

Similarly, in an intersection collision warning application, a moving target vehicle is used as a traffic target object, and the target vehicle sends a current location and motion status information of the target vehicle to the TCU. The interaction coverage area includes an area that is within an intersection range ahead of traveling of the target vehicle and that is within a specific distance from the target vehicle. Another vehicle in the area that may have tracks in various directions intersecting with those of the target vehicle is used as the first traffic participant object. After receiving the current location and the motion status information of the vehicle that is used as the first traffic participant object, the target vehicle may be vigilant of collision with the first traffic participant object when passing the intersection.

The foregoing mainly describes the solutions provided in the embodiments of this application from a perspective of interaction between different network elements. It may be understood that to implement the foregoing functions, the first local TCU, the second local TCU, the global TCU, and other TCUs include corresponding hardware structures and/or software modules for performing the functions. With reference to the units and algorithm steps described in the embodiments disclosed in this application, the embodiments of this application can be implemented in a form of hardware or hardware and computer software. Whether a function is performed by hardware or hardware driven by computer software depends on particular applications and design constraints of the technical solutions. Persons skilled in the art may use different methods to implement the described functions for each particular application, but it should not be considered that the implementation falls beyond the scope of the technical solutions in the embodiments of this application.

In the embodiments of this application, the first local TCU, the second local TCU, the global TCU, and the like may be divided into function modules or function units based on the foregoing method examples. For example, each function module or function unit may be obtained through division based on a corresponding function, or two or more functions may be integrated into one processing module or processing unit. The integrated modules or units may be implemented in a form of hardware, or may be implemented in a form of a software function module. It should be noted that, in this embodiment of this application, the module and unit division is an example, and is merely logical function division. In actual implementation, another division manner may be used. For details, refer to the following specific descriptions.

Figure 6:
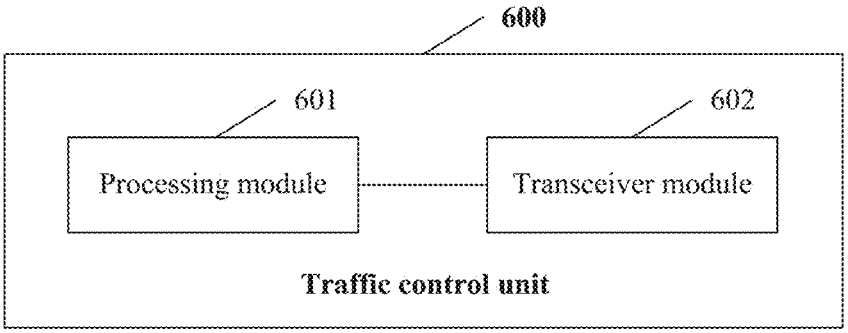
FIG. 6 is a schematic structural diagram of a traffic control apparatus according to an embodiment of the present invention.

FIG. 6 is a schematic structural diagram of a traffic control apparatus according to an embodiment of this application. The traffic control apparatus may be a first local TCU, configured to implement the first local TCU in the embodiment in FIG. 2A, FIG. 2B, and FIG. 2C. As shown in FIG. 6, the first local TCU includes a processing module 601 and a transceiver module 602.

The processing module 601 is configured to obtain a traffic application type and first traffic information, where the traffic application type is used to indicate a to-be-processed traffic scenario, and the first traffic information is information about a traffic target object in a management area of the first local TCU.

The processing module 601 is further configured to determine an interaction coverage area based on the traffic application type and the first traffic information, where the interaction coverage area is used to indicate a geographical area related in the to-be-processed traffic scenario.

The processing module 601 is further configured to determine a first area based on the interaction coverage area, the management area of the first local TCU, and a management area of the second local TCU, where the second local TCU is a local TCU adjacent to the first local TCU, the first area is at least one overlapping area between a management area of a third local TCU and the interaction coverage area and the interaction coverage area, and the third local TCU is a local TCU not adjacent to the first local TCU.

The transceiver module 602 is configured to: if the first area exists, send the traffic application type and the first traffic information to a global TCU, where a management area of the global TCU is divided into a management area of at least one local TCU, and the management area of the at least one local TCU includes the management area of the first local TCU.

Optionally, the processing module 601 is further configured to determine a second area based on the interaction coverage area and the management area of the first local TCU, where the second area is an overlapping area between the management area of the first local TCU and the interaction coverage area.

The processing module 601 is further configured to determine a traffic participant object in the second area.

The transceiver module 602 is further configured to send the first traffic information to the traffic participant object, or the transceiver module 602 is further configured to: receive second traffic information sent by the traffic participant object and send the second traffic information to the traffic target object.

Optionally, in the aspect of determining a traffic participant object in the second area, the processing module 601 is specifically configured to determine, as the traffic participant object, a communicable object that appears in the second area within a preset time.

Optionally, the second traffic information includes location information of the traffic participant object; or the second traffic information includes location information and status information of the traffic participant object.

Optionally, the transceiver module 602 is further configured to receive a first message sent by the traffic participant object, where the first message is used to indicate that the traffic participant object has acknowledged receiving of the first traffic information.

Optionally, the transceiver module 602 is further configured to send a second message to the traffic participant object, where the second message is used to indicate that the traffic participant object has acknowledged receiving of the second traffic information.

Optionally, the transceiver module 602 is further configured to send indication information to the traffic participant object, where the indication information is used to instruct the traffic participant object to send the second traffic information to the first local TCU.

Optionally, the processing module 601 is further configured to determine a third area based on the interaction coverage area and the management area of the second local TCU, where the third area is an overlapping area between the management area of the second local TCU and the interaction coverage area.

The transceiver module 602 is further configured to send the traffic application type and the first traffic information to the second local TCU.

Optionally, the transceiver module 602 is further configured to receive a third message sent by the second local TCU, where the third message is used to indicate that the second local TCU has acknowledged receiving of the traffic application type and the first traffic information.

Optionally, the transceiver module 602 is further configured to receive a fourth message sent by the global TCU, where the fourth message is used to indicate that the global TCU has acknowledged receiving of the traffic application type and the first traffic information.

Optionally, in the aspect of obtaining a traffic application type and first traffic information, the processing module 601 is specifically configured to:

obtain the traffic application type and the first traffic information of the traffic target object according to a preset condition; or receive the first traffic information, and determine the traffic application type based on the first traffic information; or determine the first traffic information and the traffic application type based on a received traffic application request of the traffic target object, where the traffic application request includes the first traffic information and a request type, and the request type is used to determine the traffic application type.

Optionally, the first traffic information includes location information of the traffic target object; or the first traffic information includes location information and status information of the traffic target object.

Optionally, the location information of the traffic target object is a current location of the traffic target object.

In the aspect of determining an interaction coverage area based on the traffic application type and the first traffic information, the processing module 601 is specifically configured to determine, as the interaction coverage area based on the traffic application type and map information, a geographical area with a distance from the current location falling within a first distance threshold by using the current location of the traffic target object as a start point, where the first distance threshold is determined based on the traffic application type.

Optionally, the processing module 601 is further configured to obtain an identifier and the management area of the second local TCU.

Optionally, the transceiver module 602 is further configured to send an identifier and the management area of the first local TCU to the global TCU.

It can be understood that, for specific implementations and corresponding beneficial effects of function blocks included in the traffic control apparatus in FIG. 6, refer to specific descriptions of the foregoing embodiment in FIG. 2A, FIG. 2B, and FIG. 2C. Details are not described herein again.

Figure 7:
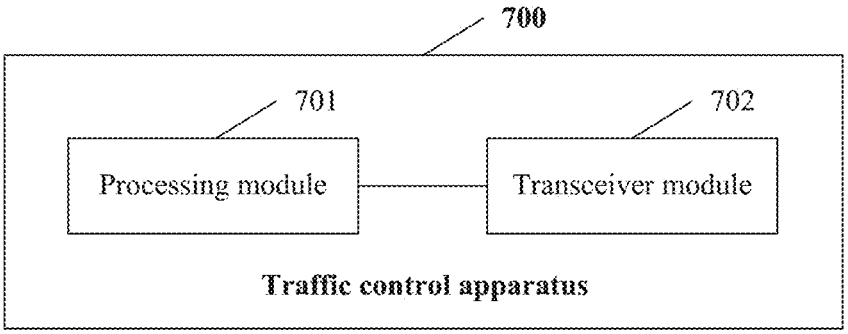
FIG. 7 is a schematic structural diagram of a traffic control apparatus according to an embodiment of the present invention.

FIG. 7 is a schematic structural diagram of a traffic control apparatus according to an embodiment of this application. The traffic control apparatus may be a global TCU, configured to implement the global TCU in the embodiment in FIG. 5A and FIG. 5B. As shown in FIG. 7, the global TCU includes a processing module 701 and a transceiver module 702.

The processing module 701 is configured to obtain a traffic application type and first traffic information, where the traffic application type is used to indicate a to-be-processed traffic scenario, the first traffic information is information about a traffic target object in a management area of the global TCU, and the management area of the global TCU is divided into a management area of at least one local TCU.

The processing module 701 is further configured to determine an interaction coverage area based on the traffic application type and the first traffic information, where the interaction coverage area is used to indicate a geographical area related in the to-be-processed traffic scenario.

The processing module 701 is further configured to determine a target local TCU based on the interaction coverage area and the management area of the at least one local TCU, where there is an overlapping area between a management area of the target local TCU and the interaction coverage area.

The transceiver module 702 is configured to send the traffic application type and the first traffic information to the target local TCU.

Optionally, in the aspect of obtaining a traffic application type and first traffic information, the processing module 701 is specifically configured to:

obtain the traffic application type and the first traffic information of the traffic target object according to a preset condition; or receive the first traffic information, and determine the traffic application type based on the first traffic information; or determine the first traffic information and the traffic application type based on a received traffic application request of the traffic target object, where the traffic application request includes the first traffic information and a request type, and the request type is used to determine the traffic application type.

Optionally, the transceiver module 702 is further configured to receive a first message sent by the target local TCU, where the first message is used to indicate that the target local TCU has acknowledged receiving of the traffic application type and the first traffic information.

Optionally, the first traffic information includes location information of the traffic target object; or the first traffic information includes location information and status information of the traffic target object.

Optionally, the location information of the traffic target object is a current location of the traffic target object.

In the aspect of determining an interaction coverage area based on the traffic application type and the first traffic information, the processing module 701 is specifically configured to determine, as the interaction coverage area based on the traffic application type and map information, a geographical area with a distance from the current location falling within a first distance threshold by using the current location of the traffic target object as a start point, where the first distance threshold is determined based on the traffic application type.

Optionally, the processing module 701 is further configured to obtain an identifier and a management area of a first local TCU, where the first local TCU is any one of the at least one local TCU.

Optionally, the transceiver module 702 is further configured to: receive second traffic information sent by the target local TCU, and send the second traffic information to the traffic target object, where the second traffic information is information about a traffic participant object in the management area of the target local TCU.

Optionally, the second traffic information includes location information of the traffic participant object; or the second traffic information includes location information and status information of the traffic participant object.

It can be understood that, for specific implementations and corresponding beneficial effects of function blocks included in the traffic control apparatus in FIG. 7, refer to specific descriptions of the foregoing embodiment in FIG. 5A and FIG. 5B. Details are not described herein again.

Figure 8:
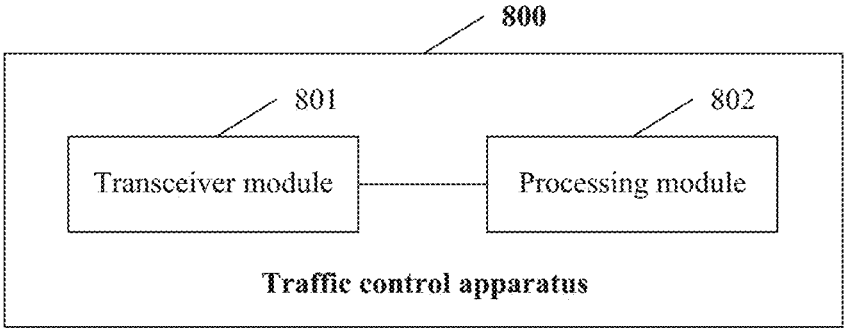
FIG. 8 is a schematic structural diagram of a traffic control apparatus according to an embodiment of the present invention.

FIG. 8 is a schematic structural diagram of a traffic control apparatus according to an embodiment of this application. The traffic control apparatus may be a global TCU, configured to implement the second local TCU in the embodiment in FIG. 2A, FIG. 2B, and FIG. 2C or configured to implement the first local TCU in the embodiment shown in FIG. 5A and FIG. 5B. As shown in FIG. 8, the first local TCU includes a transceiver module 801 and a processing module 802.

The transceiver module 801 is configured to receive a traffic application type and first traffic information that are sent by the first local TCU, where the traffic application type is used to indicate a to-be-processed traffic scenario, the first traffic information is information about a traffic target object in a management area of the global TCU, the management area of the global TCU is divided into a management area of at least one local TCU, the management area of the at least one local TCU includes a management area of the first local TCU, and the management area of the global TCU is divided into a management area of at least one local TCU.

The processing module 802 is configured to determine an interaction coverage area based on the traffic application type and the first traffic information, where the interaction coverage area is used to indicate a geographical area related in the to-be-processed traffic scenario.

The processing module 802 is further configured to determine a target local TCU based on the interaction coverage area and the management area of the at least one local TCU, where the target local TCU does not include the first local TCU and a second local TCU, the second local TCU is a local TCU adjacent to the first local TCU, and there is an overlapping area between a management area of the target local TCU and the interaction coverage area.

The transceiver module 801 is further configured to send the traffic application type and the first traffic information to the target local TCU.

Optionally, the transceiver module 801 is further configured to receive a first message sent by the target local TCU, where the first message is used to indicate that the target local TCU has acknowledged receiving of the traffic application type and the first traffic information.

Optionally, the first traffic information includes location information of the traffic target object; or the first traffic information includes location information and status information of the traffic target object.

Optionally, the location information of the traffic target object is a current location of the traffic target object.

In the aspect of determining an interaction coverage area based on the traffic application type and the first traffic information, the processing module 802 is specifically configured to determine, as the interaction coverage area based on the traffic application type and map information, a geographical area with a distance from the current location falling within a first distance threshold by using the current location of the traffic target object as a start point, where the first distance threshold is determined based on the traffic application type.

Optionally, the processing module 802 is further configured to obtain an identifier and a management area of the first local TCU, where the first local TCU is any one of the at least one local TCU.

Optionally, the transceiver module 801 is further configured to: receive second traffic information sent by the target local TCU, and send the second traffic information to the traffic target object by using the first local TCU, where the second traffic information is information about a traffic participant object in the management area of the target local TCU.

Optionally, the second traffic information includes location information of the traffic participant object; or the second traffic information includes location information and status information of the traffic participant object.

It can be understood that, for specific implementations and corresponding beneficial effects of function blocks included in the traffic control apparatus in FIG. 8, refer to specific descriptions of the foregoing embodiment in FIG. 2A, FIG. 2B, and FIG. 2C. Details are not described herein again.

Figure 9:
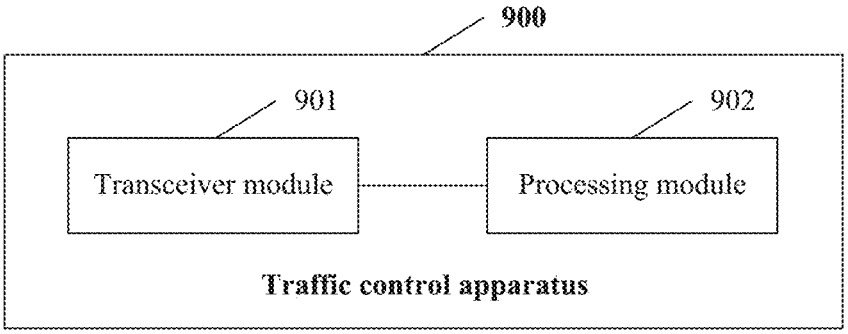
FIG. 9 is a schematic structural diagram of a traffic control apparatus according to an embodiment of the present invention.

FIG. 9 is a schematic structural diagram of a traffic control apparatus according to an embodiment of this application. The traffic control apparatus may be a first local TCU, configured to implement the second local TCU in the embodiment in FIG. 2A, FIG. 2B, and FIG. 2C or configured to implement the first local TCU in the embodiment shown in FIG. 5A and FIG. 5B. As shown in FIG. 9, the first local TCU includes a transceiver module 901 and a processing module 902.

The transceiver module 901 is configured to receive a traffic application type and first traffic information of a traffic target object that are sent by a second local TCU or a global TCU, where the traffic application type is used to indicate a to-be-processed traffic scenario, the second local TCU is a local TCU adjacent to the first local TCU, a management area of the global TCU is divided into a management area of at least one local TCU, and the management area of the at least one local TCU includes a management area of the first local TCU and a management area of the second local TCU.

The processing module 902 is configured to determine an interaction coverage area based on the traffic application type and the first traffic information, where the interaction coverage area is used to indicate a geographical area related in the to-be-processed traffic scenario.

The processing module 902 is further configured to determine a first area based on the interaction coverage area and the management area of the first local TCU, where the first area is an overlapping area between the management area of the first local TCU and the interaction coverage area.

The processing module 902 is further configured to determine a traffic participant object in the first area.

The transceiver module 901 is further configured to send the first traffic information to the traffic participant object, or the transceiver module 901 is further configured to: receive second traffic information sent by the traffic participant object and send the second traffic information to the traffic target object.

Optionally, in the aspect of determining a second traffic participant object in the overlapping area, the processing module 902 is specifically configured to determine, as the traffic participant object, a communicable object that appears in the second area within a preset time.

Optionally, the second traffic information includes location information of the traffic participant object; or the second traffic information includes location information and status information of the traffic participant object.

Optionally, the transceiver module 901 is further configured to receive a first message sent by the traffic participant object, where the first message is used to indicate that the traffic participant object has acknowledged receiving of the first traffic information.

Optionally, the transceiver module 901 is further configured to send a second message to the traffic participant object, where the second message is used to indicate that the traffic participant object has acknowledged receiving of the second traffic information.

Optionally, the transceiver module 901 is further configured to send indication information to the traffic participant object, where the indication information is used to instruct the traffic participant object to feed back the second traffic information.

Optionally, the first traffic information includes location information of the traffic target object; or the first traffic information includes location information and status information of the traffic target object.

Optionally, the location information of the traffic target object is a current location of the traffic target object.

In the aspect of determining an interaction coverage area based on the traffic application type and the first traffic information, the processing module 902 is specifically configured to determine, as the interaction coverage area based on the traffic application type and map information, a geographical area with a distance from the current location falling within a first distance threshold by using the current location of the traffic target object as a start point, where the first distance threshold is determined based on the traffic application type.

Optionally, the processing module 902 is further configured to obtain an identifier and the management area of the second local TCU.

Optionally, the transceiver module 901 is further configured to send an identifier and the management area of the first local TCU to the global TCU.

Optionally, in the aspect of sending the second traffic information to the traffic target object, the transceiver module 901 is specifically configured to:

when the traffic application type and the first traffic information are sent by the second local TCU, send the second traffic information to the traffic target object by using the second local TCU; or when the traffic application type and the first traffic information are sent by the global TCU, send, by the first local TCU, the second traffic information to the traffic target object.

It can be understood that, for specific implementations and corresponding beneficial effects of function blocks included in the traffic control apparatus in FIG. 9, refer to specific descriptions of the foregoing embodiment in FIG. 5A and FIG. 5B. Details are not described herein again.

Figure 10:
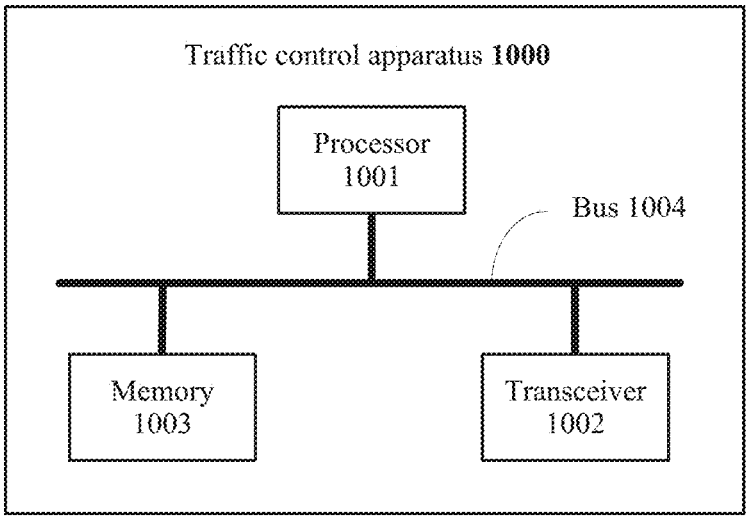
FIG. 10 is a schematic structural diagram of a traffic control apparatus according to an embodiment of the present invention.

The traffic control apparatuses in the embodiment shown in FIG. 6, FIG. 7, FIG. 8, or FIG. 9 may be implemented by a traffic control apparatus 1000 shown in FIG. 10. FIG. 10 is a schematic structural diagram of another traffic control apparatus 1000 according to an embodiment of the present invention. The traffic control apparatus 1000 shown in FIG. 10 includes a processor 1001 and a transceiver 1002. The transceiver 1002 is configured to support information transmission between the traffic control apparatus 1000 and the traffic target object related in the foregoing embodiment or another traffic control apparatus, for example, the transceiver 1002 is configured to implement actions performed by any transceiver module in FIG. 6, FIG. 7, FIG. 8, or FIG. 9, and the processor 1001 is configured to implement actions performed by any processing module in FIG. 6, FIG. 7, FIG. 8, or FIG. 9. The processor 1001 is communicatively connected to the transceiver 1002, for example, by using a bus 1004. The traffic control apparatus 1000 may further include a memory 1003. The memory 1003 is configured to store program code and data that are executed by the traffic control apparatus 1000, and the processor 1001 is configured to execute application program code stored in the memory 1003, to implement actions of the traffic control apparatus provided in any one of the embodiments shown in FIG. 2A, FIG. 2B, and FIG. 2C to FIG. 5A and FIG. 5B.

It should be noted that, in actual application, the traffic control apparatus may include one or more processors, and a structure of the traffic control apparatus 1000 does not constitute a limitation on this embodiment of this application.

The processor 1001 may be a central processing unit (CPU), a network processor (NP), a hardware chip, or any combination thereof. The hardware chip may be an application-specific integrated circuit (ASIC), a programmable logic device (PLD), or a combination thereof. The PLD may be a complex programmable logic device (CPLD), a field-programmable gate array (FPGA), generic array logic (GAL), or any combination thereof.

The memory 1003 may include a volatile memory (volatile memory), for example, a random access memory (RAM). Alternatively, the memory 1003 may include a non-volatile memory (non-volatile memory), for example, a read-only memory (ROM), a flash memory (flash memory), a hard disk drive (HDD), or a solid-state drive (SSD). Alternatively, the memory 1003 may include a combination of the foregoing types of memories.

An embodiment of the present invention further provides a computer storage medium, and the computer storage medium may be configured to store a computer software instruction used by the traffic control apparatus in the embodiment shown in FIG. 6, FIG. 7, FIG. 8, or FIG. 9. The computer software instruction includes a program that is designed for the traffic control apparatus to perform the foregoing embodiment. The storage medium includes but is not limited to a flash memory, a hard disk drive, and a solid-state drive.

An embodiment of the present invention further provides a computer program product. When the computer program product is run by a computing device, the computing device may perform the communication method designed for the traffic control apparatus in the embodiment in FIG. 6, FIG. 7, FIG. 8, or FIG. 9.

In the embodiments of the present invention, the traffic control apparatus related in the embodiment in FIG. 6, FIG. 7, FIG. 8, or FIG. 9 may be a traffic control unit. This is not limited in the embodiments of the present invention.

In the specification, claims, and accompanying drawings of this application, the terms "first", "second", "third", "fourth", and so on are intended to distinguish between different objects but do not indicate a particular order. In addition, the terms "including" and "having" and any other variants thereof are intended to cover a non-exclusive inclusion. For example, a process, a method, a system, a product, or a device that includes a series of steps or units is not limited to the listed steps or units, but optionally further includes an unlisted step or unit, or optionally further includes another inherent step or unit of the process, the method, the product, or the device.

Persons of ordinary skill in the art may understand that sequence numbers of the foregoing processes do not mean execution sequences in various embodiments of this application. The execution sequences of the processes should be determined based on functions and internal logic of the processes, and should not be construed as any limitation on the implementation processes of the embodiments of this application.

All or some of the foregoing embodiments may be implemented through software, hardware, firmware, or any combination thereof. When software is used to implement the embodiments, the embodiments may be implemented completely or partially in a form of a computer program product. The computer program product includes one or more computer instructions. When the computer program instructions are loaded and executed on the computer, the procedure or functions according to the embodiments of the present invention are all or partially generated. The computer may be a general-purpose computer, a dedicated computer, a computer network, or other programmable apparatuses. The computer instructions may be stored in a computer-readable storage medium or may be transmitted from a computer-readable storage medium to another computer-readable storage medium. For example, the computer instructions may be transmitted from a website, computer, server, or data center to another website, computer, server, or data center in a wired (for example, a coaxial cable, an optical fiber, or a digital subscriber line (DSL)) or wireless (for example, infrared, radio, or microwave) manner. The computer-readable storage medium may be any usable medium accessible by a computer, or a data storage device, such as a server or a data center, integrating one or more usable media. The usable medium may be a magnetic medium (for example, a floppy disk, a hard disk drive, or a magnetic tape), an optical medium (for example, a DVD), a semiconductor medium (for example, a solid-state drive Solid-State Disk (SSD)), or the like.

Persons of ordinary skill in the art may understand that all or some of the processes of the methods in the embodiments may be implemented by a computer program instructing related hardware. The program may be stored in a computer-readable storage medium. When the program runs, the processes of the methods in the embodiments are performed. The foregoing storage medium may include: a magnetic disk, an optical disc, a read-only memory (ROM), or a random access memory (RAM).

What is disclosed above is merely example embodiments of the present invention, and certainly is not intended to limit the protection scope of the present invention. Therefore, equivalent variations made in accordance with the claims of the present invention shall fall within the scope of the present invention.

What is claimed is:

1. A traffic information processing method, comprising:

obtaining, by a first local traffic control unit_(TCU), a traffic application type and first traffic information, wherein the traffic application type is used to indicate a to-be-processed traffic scenario, and wherein the first traffic information is information about a traffic target object in a management area of the first local TCU;

determining, by the first local TCU, an interaction coverage area based on the traffic application type and the first traffic information, wherein the interaction coverage area is used to indicate a geographical area related to the to-be-processed traffic scenario; and determining, by the first local TCU, a first area based on the interaction coverage area, the management area of the first local TCU, and a management area of a second local TCU, and sending the traffic application type and the first traffic information to a global TCU, wherein the second local TCU is a local TCU adjacent to the first local TCU, wherein the first area is at least one overlapping area between a management area of a third local TCU and the interaction coverage area, wherein the third local TCU is a local TCU not adjacent to the first local TCU, wherein a management area of the global TCU is divided into at least one management area of at least one local TCU, and wherein the at least one management area of the at least one local TCU comprises the management area of the first local TCU.

2. The method according to claim 1, after the determining, by the first local TCU, an interaction coverage area based on the traffic application type and the first traffic information, further comprising:

determining, by the first local TCU, a second area based on the interaction coverage area and the management area of the first local TCU, wherein the second area is an overlapping area between the management area of the first local TCU and the interaction coverage area;

determining, by the first local TCU, a traffic participant object in the second area; and sending, by the first local TCU, the first traffic information to the traffic participant object, or receiving, by the first local TCU, second traffic information sent by the traffic participant object and sending the second traffic information to the traffic target object.

3. The method according to claim 2, wherein the determining, by the first local TCU, a traffic participant object in the second area comprises:

determining, as the traffic participant object by the first local TCU, a communicable object that appears in the second area within a preset time.

4. The method according to claim 2, wherein:

the second traffic information comprises location information of the traffic participant object; or the second traffic information comprises location information and status information of the traffic participant object.

5. The method according to claim 1, wherein:

the first traffic information comprises location information of the traffic target object; or the first traffic information comprises location information and status information of the traffic target object.

6. The method according to claim 5, wherein the location information of the traffic target object is a current location of the traffic target object, and wherein the determining, by the first local TCU, an interaction coverage area based on the traffic application type and the first traffic information comprises:

determining, as the interaction coverage area by the first local TCU based on the traffic application type and map information, a geographical area with a distance from the current location falling within a first distance threshold by using the current location of the traffic target object as a start point, wherein the first distance threshold is determined based on the traffic application type.

7. A traffic information processing method, comprising:

obtaining, by a global traffic control unit_(TCU), a traffic application type and first traffic information, wherein the traffic application type is used to indicate a to-be-processed traffic scenario, wherein the first traffic information is information about a traffic target object in a management area of the global TCU, and wherein the management area of the global TCU is divided into at least one management area of at least one local TCU;

determining, by the global TCU, an interaction coverage area based on the traffic application type and the first traffic information, wherein the interaction coverage area is used to indicate a geographical area related to the to-be-processed traffic scenario;

determining, by the global TCU, a target local TCU based on the interaction coverage area and the at least one management area of the at least one local TCU, wherein there is an overlapping area between a management area of the target local TCU and the interaction coverage area; and sending, by the global TCU, the traffic application type and the first traffic information to the target local TCU.

8. The method according to claim 7, after the sending, by the global TCU, the traffic application type and the first traffic information to the target local TCU, further comprising:

receiving, by the global TCU, a first message sent by the target local TCU, wherein the first message is used to indicate that the target local TCU has acknowledged receiving of the traffic application type and the first traffic information.

9. The method according to claim 7, further comprising:

obtaining, by the global TCU, an identifier and a management area of a first local TCU, wherein the first local TCU is any one of the at least one local TCU.

10. The method according to claim 7, further comprising:

receiving, by the global TCU, second traffic information sent by the target local TCU, and sending the second traffic information to the traffic target object, wherein the second traffic information is information about a traffic participant object in the management area of the target local TCU.

11. The method according to claim 10, wherein:

the second traffic information comprises location information of the traffic participant object; or the second traffic information comprises location information and status information of the traffic participant object.

12. A traffic information processing method, comprising:

receiving, by a global traffic control unit(TCU), a traffic application type and first traffic information that are sent by a first local TCU, wherein the traffic application type is used to indicate a to-be-processed traffic scenario, wherein the first traffic information is information about a traffic target object in a management area of the global TCU, wherein the management area of the global TCU is divided into at least one management area of at least one local TCU, wherein the at least one management area of the at least one local TCU comprises a management area of the first local TCU;

determining, by the global TCU, an interaction coverage area based on the traffic application type and the first traffic information, wherein the interaction coverage area is used to indicate a geographical area related to the to-be-processed traffic scenario;

determining, by the global TCU, a target local TCU based on the interaction coverage area and the at least one management area of the at least one local TCU, wherein the target local TCU does not comprise the first local TCU or a second local TCU, wherein the second local TCU is a local TCU adjacent to the first local TCU, and wherein there is an overlapping area between a management area of the target local TCU and the interaction coverage area; and sending, by the global TCU, the traffic application type and the first traffic information to the target local TCU.

13. The method according to claim 12, further comprising:

receiving, by the global TCU, second traffic information sent by the target local TCU, and sending the second traffic information to the traffic target object by using the first local TCU, wherein the second traffic information is information about a traffic participant object in the management area of the target local TCU.

14. A traffic information processing method, comprising:

receiving, by a first local traffic control unit_(TCU), a traffic application type and first traffic information of a traffic target object that are sent by a second local TCU or a global TCU, wherein the traffic application type is used to indicate a to-be-processed traffic scenario, wherein the second local TCU is a local TCU adjacent to the first local TCU, wherein a management area of the global TCU is divided into at least one management area of at least one local TCU, and wherein the at least one management area of the at least one local TCU comprises a management area of the first local TCU and a management area of the second local TCU;

determining, by the first local TCU, an interaction coverage area based on the traffic application type and the first traffic information, wherein the interaction coverage area is used to indicate a geographical area related to the to-be-processed traffic scenario;

determining, by the first local TCU, a first area based on the interaction coverage area and the management area of the first local TCU, wherein the first area is an overlapping area between the management area of the first local TCU and the interaction coverage area;

determining, by the first local TCU, a traffic participant object in the first area; and sending, by the first local TCU, the first traffic information to the traffic participant object, or receiving, by the first local TCU, second traffic information sent by the traffic participant object and sending the second traffic information to the traffic target object.

15. The method according to claim 14, wherein the sending, by the first local TCU, the second traffic information to the traffic target object comprises:

in response to determining that the traffic application type and the first traffic information are sent by the second local TCU, sending, by the first local TCU, the second traffic information to the traffic target object by using the second local TCU; or in response to determining that the traffic application type and the first traffic information are sent by the global TCU, sending, by the first local TCU, the second traffic information to the traffic target object by using the global TCU.

16. A traffic control apparatus, comprising:

at least one processor; and a non-transitory computer-readable storage medium coupled to the at least one processor and storing programming instructions for execution by the at least one processor, wherein the programming instructions instruct the at least one processor to:

obtain by a first local traffic control unit (TCU), a traffic application type and first traffic information, wherein the traffic application type is used to indicate a to-be-processed traffic scenario, and wherein the first traffic information is information about a traffic target object in a management area of the first local TCU;

determine, by the first local TCU, an interaction coverage area based on the traffic application type and the first traffic information, wherein the interaction coverage area is used to indicate a geographical area related to the to-be-processed traffic scenario; and determine, by the first local TCU, a first area based on the interaction coverage area, the management area of the first local TCU, and a management area of a second local TCU, and sending the traffic application type and the first traffic information to a global TCU, wherein the second local TCU is a local TCU adjacent to the first local TCU, wherein the first area is at least one overlapping area between a management area of a third local TCU and the interaction coverage area, wherein the third local TCU is a local TCU not adjacent to the first local TCU, wherein a management area of the global TCU is divided into at least one management area of at least one local TCU, and wherein the at least one management area of the at least one local TCU comprises the management area of the first local TCU.

17. A traffic control apparatus, comprising:

at least one processor; and a non-transitory computer-readable storage medium coupled to the at least one processor and storing programming instructions for execution by the at least one processor, wherein the programming instructions instruct the at least one processor to:

obtain, by a global traffic control unit (TCU), a traffic application type and first traffic information, wherein the traffic application type is used to indicate a to-be-processed traffic scenario, wherein the first traffic information is information about a traffic target object in a management area of the global TCU, and wherein the management area of the global TCU is divided into at least one management area of at least one local TCU;

determine, by the global TCU, an interaction coverage area based on the traffic application type and the first traffic information, wherein the interaction coverage area is used to indicate a geographical area related to the to-be-processed traffic scenario;

determine, by the global TCU, a target local TCU based on the interaction coverage area and the at least one management area of the at least one local TCU, wherein there is an overlapping area between a management area of the target local TCU and the interaction coverage area; and send, by the global TCU, the traffic application type and the first traffic information to the target local TCU.

18. A traffic control apparatus, comprising:

at least one processor; and a non-transitory computer-readable storage medium coupled to the at least one processor and storing programming instructions for execution by the at least one processor, wherein the programming instructions instruct the at least one processor to:

receive, by a global traffic control unit(TCU), a traffic application type and first traffic information that are sent by a first local TCU, wherein the traffic application type is used to indicate a to-be-processed traffic scenario, wherein the first traffic information is information about a traffic target object in a management area of the global TCU, wherein the management area of the global TCU is divided into at least one management area of at least one local TCU, wherein the at least one management area of the at least one local TCU comprises a management area of the first local TCU;

determine, by the global TCU, an interaction coverage area based on the traffic application type and the first traffic information, wherein the interaction coverage area is used to indicate a geographical area related to the to-be-processed traffic scenario;

determine, by the global TCU, a target local TCU based on the interaction coverage area and the at least one management area of the at least one local TCU, wherein the target local TCU does not comprise the first local TCU or a second local TCU, wherein the second local TCU is a local TCU adjacent to the first local TCU, and wherein there is an overlapping area between a management area of the target local TCU and the interaction coverage area; and send, by the global TCU, the traffic application type and the first traffic information to the target local TCU.

19. A traffic control apparatus, comprising:

at least one processor; and a non-transitory computer-readable storage medium coupled to the at least one processor and storing programming instructions for execution by the at least one processor, wherein the programming instructions instruct the at least one processor to:

receive, by a first local traffic control unit (TCU), a traffic application type and first traffic information of a traffic target object that are sent by a second local TCU or a global TCU, wherein the traffic application type is used to indicate a to-be-processed traffic scenario, wherein the second local TCU is a local TCU adjacent to the first local TCU, wherein a management area of the global TCU is divided into at least one management area of at least one local TCU, and wherein the at least one management area of the at least one local TCU comprises a management area of the first local TCU and a management area of the second local TCU;

determine, by the first local TCU, an interaction coverage area based on the traffic application type and the first traffic information, wherein the interaction coverage area is used to indicate a geographical area related to the to-be-processed traffic scenario;

determine, by the first local TCU, a first area based on the interaction coverage area and the management area of the first local TCU, wherein the first area is an overlapping area between the management area of the first local TCU and the interaction coverage area;

determine, by the first local TCU, a traffic participant object in the first area; and send, by the first local TCU, the first traffic information to the traffic participant object, or receiving, by the first local TCU, second traffic information sent by the traffic participant object and sending the second traffic information to the traffic target object.

* * * * *